US010279607B2

(12) United States Patent
Baumeister et al.

(10) Patent No.: US 10,279,607 B2
(45) Date of Patent: May 7, 2019

(54) PRINTING ASSEMBLY AND METHOD FOR OPERATING A PRINTING ASSEMBLY

(71) Applicant: KOENIG & BAUER AG, Würzburg (DE)

(72) Inventors: Thomas Baumeister, Würzburg (DE); Alexander Blank, Würzburg (DE); Klaus Förtig, Würzburg (DE); Andreas Rumpel, Eussenheim (DE); Christian Schlund, Billingshausen (DE); Patrick Walter, Kirchzell (DE)

(73) Assignee: Koenig & Bauer AG, Wurzburg (DE)

( * ) Notice: Subject to any disclaimer, the term of this patent is extended or adjusted under 35 U.S.C. 154(b) by 0 days.

(21) Appl. No.: 15/764,505

(22) PCT Filed: Nov. 15, 2016

(86) PCT No.: PCT/EP2016/077661
§ 371 (c)(1),
(2) Date: Aug. 7, 2018

(87) PCT Pub. No.: WO2017/085040
PCT Pub. Date: May 26, 2017

(65) Prior Publication Data

US 2018/0361764 A1 Dec. 20, 2018

(30) Foreign Application Priority Data

Nov. 17, 2015 (DE) ..... 10 2015 222 622

(51) Int. Cl.
*B41J 11/00* (2006.01)
*B41J 15/04* (2006.01)
(Continued)

(52) U.S. Cl.
CPC ..... *B41J 15/04* (2013.01); *B41J 2/04563* (2013.01); *B41J 11/002* (2013.01); *B41J 29/38* (2013.01); *B41J 3/543* (2013.01); *B41J 11/00* (2013.01)

(58) Field of Classification Search
CPC ..... B41J 15/04; B41J 2/04563; B41J 11/002; B41J 29/38; B41J 3/543; B41J 11/00
See application file for complete search history.

(56) References Cited

U.S. PATENT DOCUMENTS 9,403,367 B2 8/2016 Reder et al.
2005/0024421 A1* 2/2005 Barinaga ..... B41J 2/16517 347/22

(Continued)

FOREIGN PATENT DOCUMENTS

WO 2014/184126 A 11/2014

OTHER PUBLICATIONS

International Search Report of PCT/EP2016/077661 dated Mar. 17, 2017.

*Primary Examiner* — Yaovi M Ameh
(74) *Attorney, Agent, or Firm* — Mattingly & Malur, PC

(57) ABSTRACT

A printing assembly has at least one transport direction defined by a transport path provided for the transport of printing material through the printing assembly. The printing assembly has at least one first support body on which at least one first image-generating device is arranged and which at least one first support body extends both in the transport direction and in a transverse direction that is oriented horizontally and orthogonally to the transport direction. The printing assembly has at least one first temperature-control device for the targeted generation of a temperature difference between a first point of the at least one first support body and at least one second point of the at least one first (Continued)

support body. That second point is spaced apart from the first point, at least in the transport direction.

15 Claims, 5 Drawing Sheets

(51) Int. Cl.

| | |
|---|---|
| ***B41J 29/38*** | (2006.01) |
| ***B41J 2/045*** | (2006.01) |
| *B41J 3/54* | (2006.01) |

(56) References Cited

U.S. PATENT DOCUMENTS

| | | | | |
|---|---|---|---|---|
| 2013/0127971 | A1 | 5/2013 | Heath | |
| 2013/0265359 | A1* | 10/2013 | Sugaya | B41J 11/002 347/16 |
| 2017/0232760 | A1* | 8/2017 | Nishitani | B41J 2/0057 347/102 |

* cited by examiner

PRINTING ASSEMBLY AND METHOD FOR OPERATING A PRINTING ASSEMBLY

CROSS-REFERENCE TO RELATED APPLICATIONS

This application is the U.S. National Phase, under 35 U.S.C. § 371, of PCT/EP2016/077661, filed Nov. 15, 2016; published as WO2017/085040A1 on May 26, 2017 and claiming priority to DE 10 2015 222 622.0, filed Nov. 17, 2015, the disclosures of which are expressly incorporated herein in their entireties by reference.

FIELD OF THE INVENTION

The present invention relates to a printing unit and to a method for operating a printing unit wherein at least one transport device is defined by a transport path for the transport of printed substrate through the printing unit, and wherein the printing unit has at least one first supporting body, on which at least one first image-generating device is located and which extends both the transport direction and in a transverse direction, which are oriented horizontally and orthogonally to the transport direction.

BACKGROUND OF THE INVENTION

Various printing methods are used in printing machines. Non-impact printing methods (NIP) are understood as printing methods that do not require a fixed, i.e. physically invariable, printing forme. Printing methods of this type can be used to produce a different print image in every printing operation. Examples of non-impact printing methods include ionographic methods, magnetographic methods, thermographic methods, electrophotography, laser printing and especially inkjet printing methods. Printing methods of this type typically involve at least one image-generating device, for example, at least one print head. In the case of the inkjet printing method, such a print head is embodied as an inkjet print head, for example, and has at least one nozzle, preferably a plurality of nozzles, by means of which at least one printing fluid in the form of ink droplets, for example, can be transferred in a targeted manner to a printing substrate.

The precise matching of a printed image on the front and back sides of a substrate that is printed on both sides is referred to as register (DIN 16500-2). In multi-color printing, the process of combining individual printed images of different colors in a precise correlation to form an image is referred to as color registration (DIN 16500-2). In inkjet printing, as in other printing methods, suitable measures for maintaining color registration and/or register are required. In particular, it is important for the relative position between print head and printing substrate to be known and/or kept constant.

A printing unit in which print heads are mounted on respective supporting bodies is known from WO 2014/184126 A1.

A device by means of which an individual print head can be displaced in a compensation direction is known from US 2013/0127971 A1. If print heads that are mounted adjacent to one another on a common supporting body become displaced relative to one another in the compensation direction as a result of thermal expansion of the supporting body, a lock can be opened, the print head can be displaced relative to the supporting body with respect to the compensation direction by heating and thermal expansion of an expansion block, and the lock can be closed again.

SUMMARY OF THE INVENTION

The object of the present invention is to devise a printing unit and a method for operating a printing unit.

The object is achieved according to the invention by the provision of the printing unit having at least one first temperature control device for the targeted generation of a temperature difference between a first point on the at least one first supporting body of the printing unit and a second point on the at least one first supporting body, the second point being spaced apart from the first point at least in the transport direction. In a method for operating a printing press, in accordance with the present invention, and that has at least one first supporting body on which at least one first image-generating device is located, at least one transport direction is defined by a transport path provided for the transport of printing substrate through the printing unit. Position information regarding the position of at least one first reference point, located on the at least one first supporting body, in relation to at least one other reference point is obtained from a measurement. The at least one other reference point is stationary relative to a second supporting body of the printing unit. The second supporting body supports at least one second image-generating device. Based at least on this position information, at least one first temperature control means is operated in one of a controlled and a regulated manner for the targeted influencing of the temperature at least in a first point on the at least one first supporting body. Alternatively, the at least one other reference point may be stationary relative to one of a frame of the printing unit and relative to the second supporting body of the printing unit. During a printing operation of the printing unit, the at least one first temperature control means is operated in the one of the controlled and a regulated manner based at least on this position information.

One advantage of a printing unit in which at least one transport direction is defined by a transport path provided for the transport of printing substrate through the printing unit, and in which the printing unit comprises at least one first supporting body, on which at least one first image-generating device is mounted and which extends both in the transport direction and in a transverse direction that is oriented horizontally and orthogonally to the transport direction, and in which the printing unit comprises at least one first temperature control device for the targeted generation of a temperature difference between a first point on said at least one first supporting body and a second point on said at least one first supporting body, the second point being spaced from said first point, at least in the transport direction, consists in particular in that deflections of this supporting body, and thus the position of the at least one image-generating device with respect to the transport direction, can be influenced in a targeted manner, thereby enabling high print image quality to be readily achieved.

This advantage is also realized by a method for operating a printing unit that comprises at least one first supporting body, on which at least one first image-generating device is mounted, wherein at least one transport direction is defined by a transport path provided for the transport of printing substrate through the printing unit, and wherein position information regarding the position of at least one first reference point, located on the at least one first supporting body, relative to at least one other reference point is obtained from a measurement, and wherein the at least one other reference point is stationary relative to a frame of the printing unit and/or is stationary relative to a second supporting body of the printing unit, which second supporting body supports at least one second image-generating device, and wherein based at least on this position information, at least one first temperature control means is operated in a controlled and/or regulated manner for the targeted influencing of the temperature at least at a first point on said at least one first supporting body.

The invention can preferably be used for a variety of non-impact printing methods, in particular for ionographic methods, magnetographic methods, thermographic methods, electrophotography, laser printing and especially inkjet printing methods. In the above and in the following, embodiments and variants that are described for "printing inks"—as long as no clear contradiction is apparent—refer to any kind of flowable printing fluids, including, in particular, colored or colorless coating media and relief-forming materials such as pastes, for example, and may be conveyed by the—intended or actual—replacement of the term "printing ink" with the more generalized term "printing fluid" or with a specialized term such as "varnish", "high viscosity printing ink", "low viscosity printing ink" or "ink", or "paste" or "pasty material".

The printing unit may have a central cylinder or a multiplicity of rotatable and/or stationary printing substrate guide elements, without restricting the advantages as a result.

BRIEF DESCRIPTION OF THE DRAWINGS

An exemplary embodiment of the invention is illustrated in the set of drawings and will be described in greater detail below.

The figures show.

DESCRIPTION OF PREFERRED EMBODIMENTS

Figure 1:
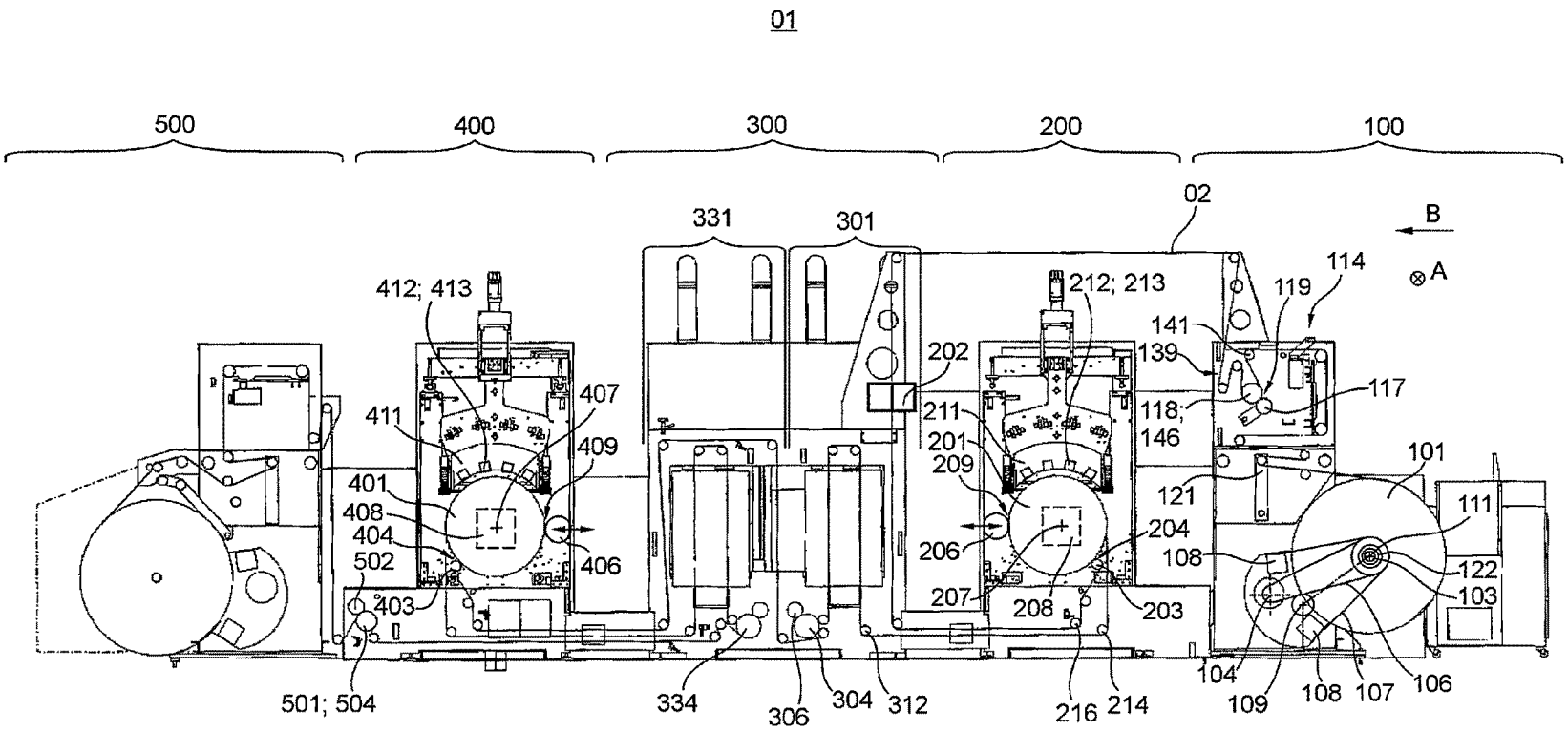
FIG. 1 a diagram of a printing machine.
Figure 2:
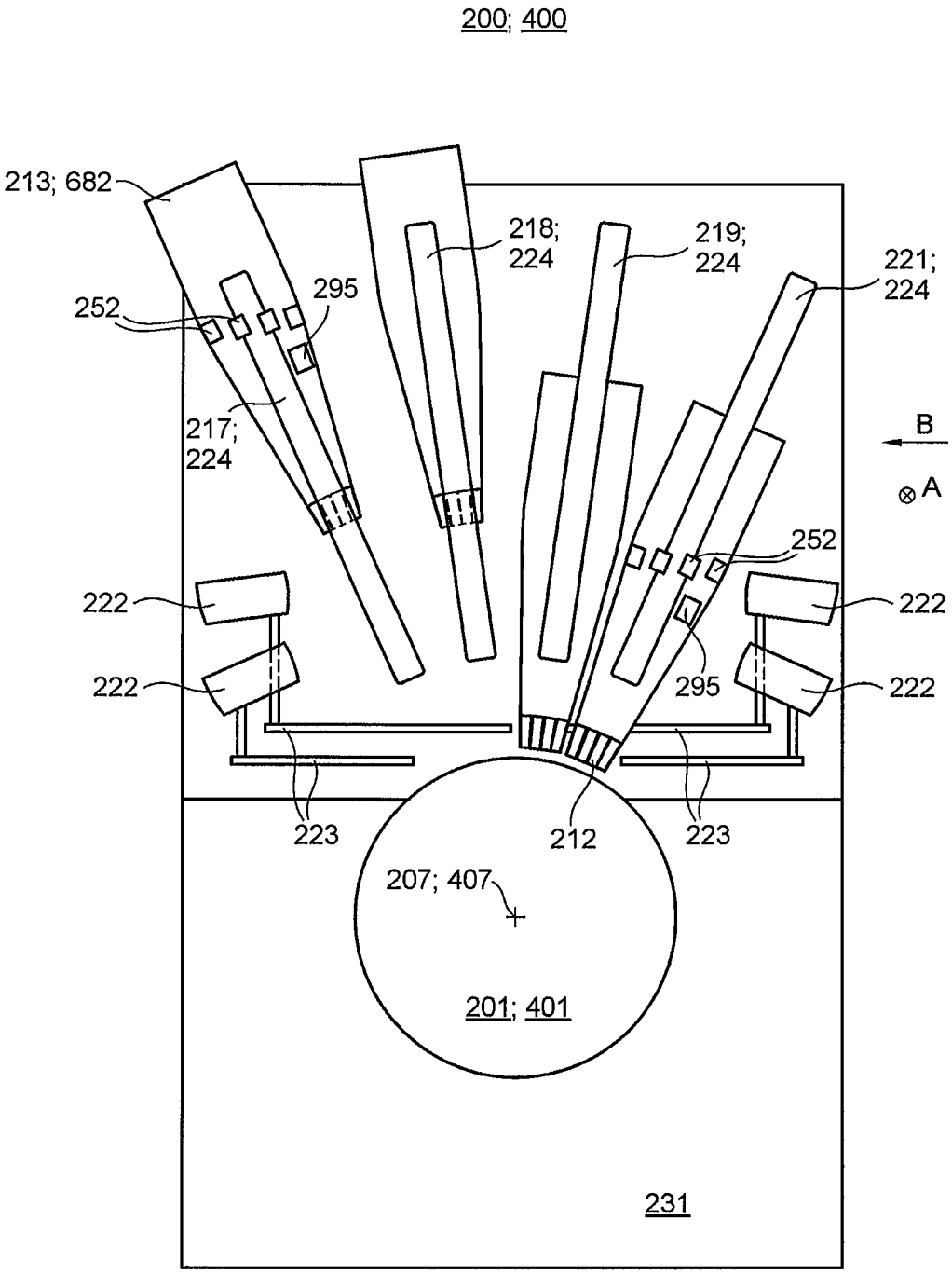
FIG. 2 a diagram of a printing unit having four positioning devices and four maintenance devices, in which some print heads are disposed in printing positions and some are disposed in idle positions embodied as installation positions, for example.
Figure 3:
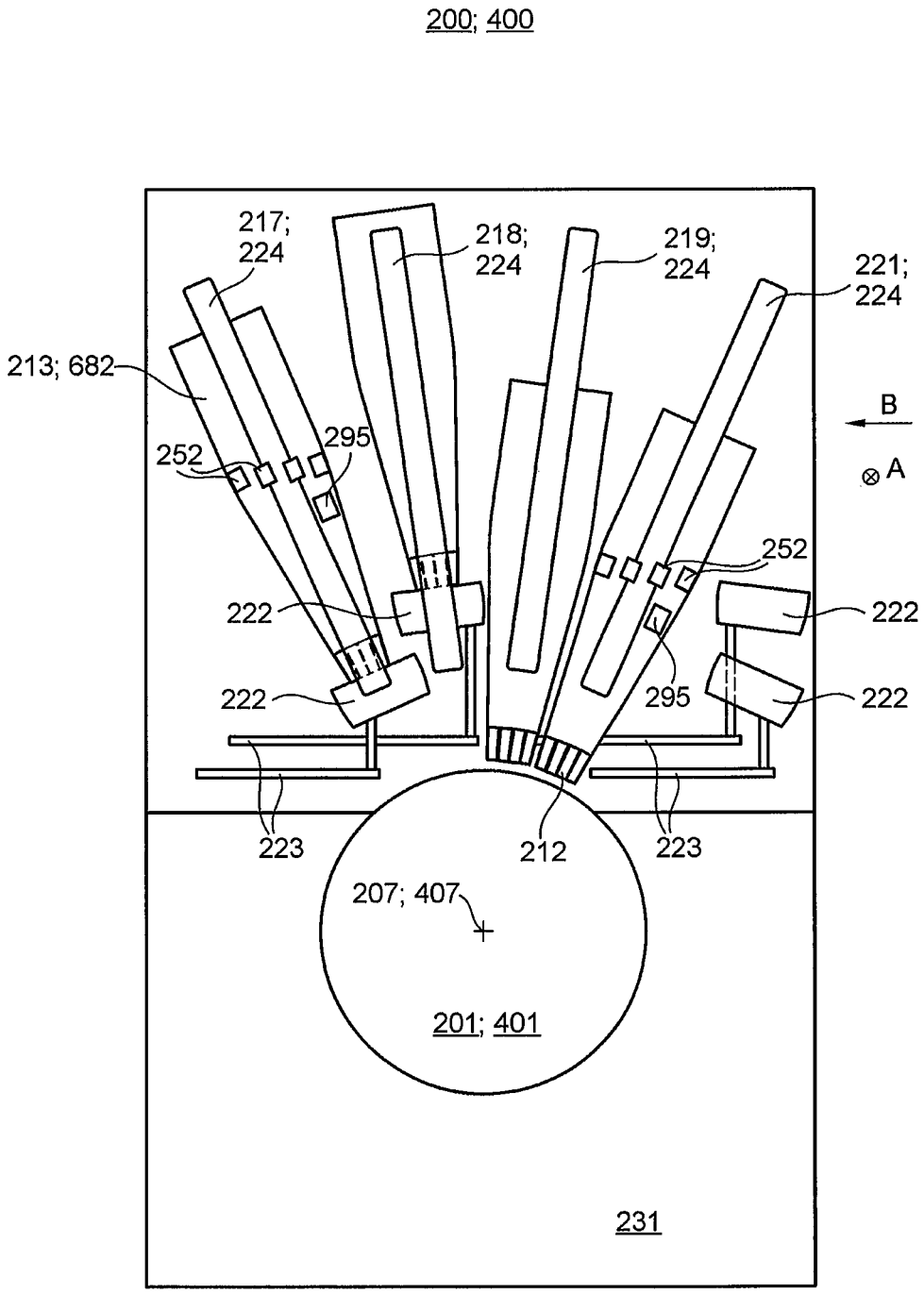
FIG. 3 a diagram of a printing unit according to FIG. 2, in which print heads are placed in maintenance positions having associated maintenance devices by means of the two left positioning devices.
Figure 4:
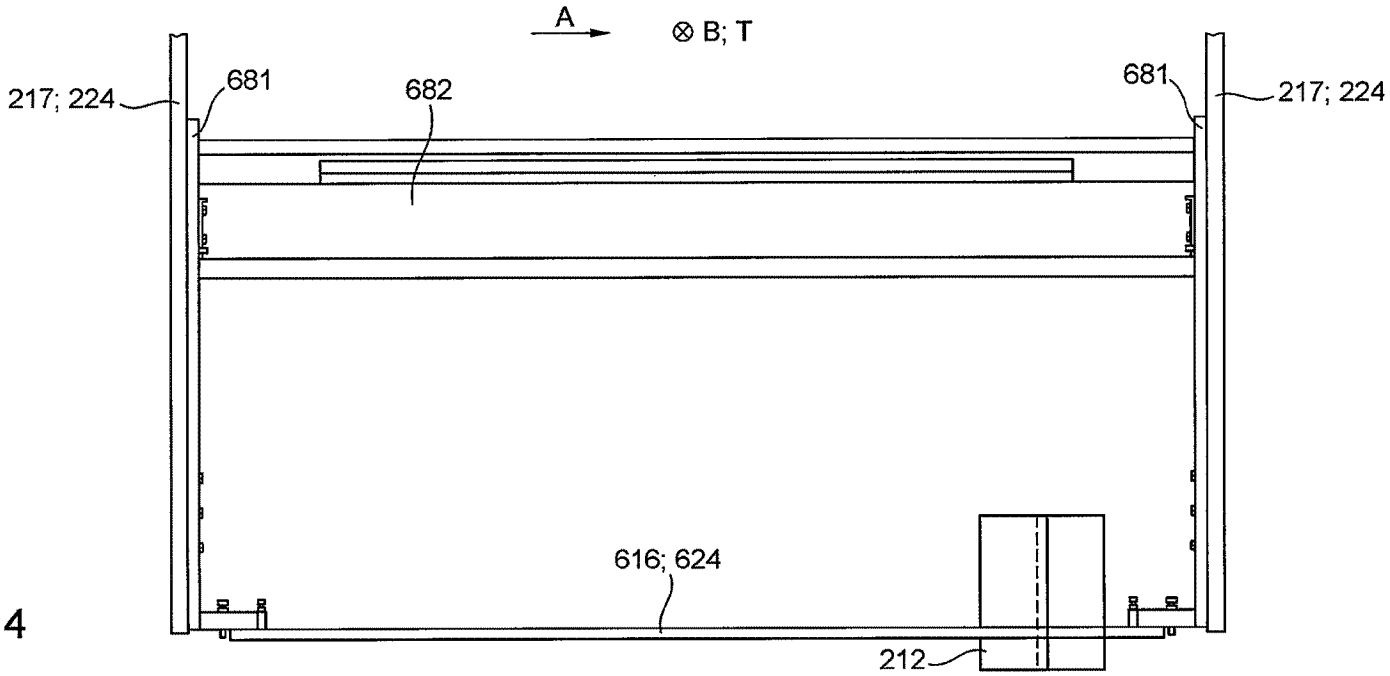
FIG. 4 a diagram showing a part of a supporting body and a positioning device as viewed in a longitudinal direction, with only part of a set of print heads being shown, in the interest of simplicity.
Figure 5:
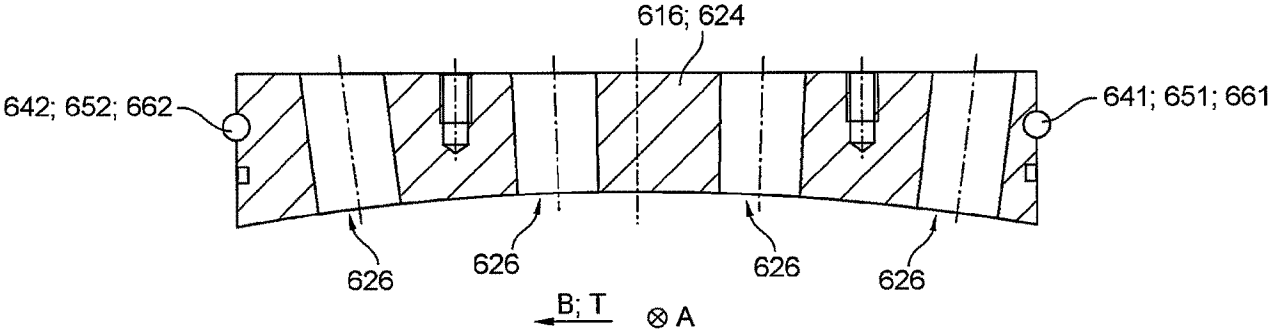
FIG. 5 a diagram of a supporting body, as viewed in a transverse direction.
Figure 6:
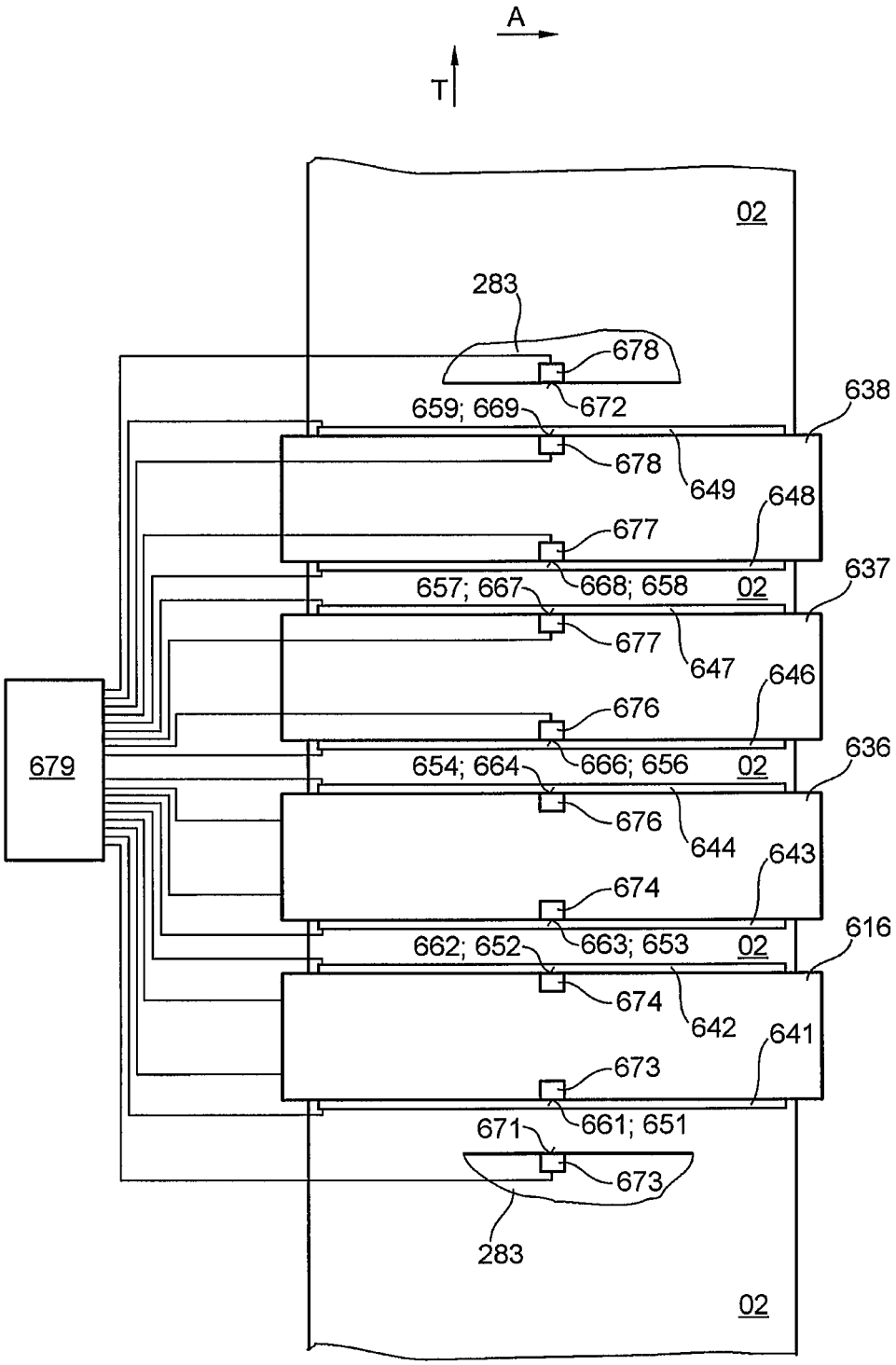
FIG. 6 a diagram of a plurality of supporting bodies arranged one behind the other in the longitudinal direction, with sensors and devices connected thereto.

In the above and in the following, the term printing fluid includes inks and printing inks, but also varnishes and pasty materials. Printing fluids are preferably materials that are and/or can be transferred by a printing machine 01 or by at least one printing unit 200 of the printing machine 01 to a printing substrate 02, thereby creating a texture on the printing substrate 02, preferably in a finely structured form and/or not merely over a large surface area, which texture is preferably visible and/or can be perceived by sensory impression and/or can be detected by machine. Inks and printing inks are preferably solutions or dispersions of at least one colorant in at least one solvent. Suitable solvents include water and/or organic solvents, for example. Alternatively or additionally, the printing fluid may be embodied as printing fluid that cures under UV light. Inks are relatively low viscosity printing fluids, and printing inks are relatively high viscosity printing fluids. Inks preferably contain no binder or relatively little binder, whereas printing inks preferably contain a relatively large amount of binder and more preferably additional auxiliary agents. Colorants may be pigments and/or dyes, with pigments being insoluble in the application medium, whereas dyes are soluble in the application medium.

For the sake of simplicity, in the above and in the following—unless otherwise explicitly distinguished and designated accordingly—the term "printing ink" is understood as a liquid or at least flowable coloring fluid to be used for printing in the printing machine, and includes not only the higher viscosity coloring fluids for use in rotary printing machines, more frequently associated with the colloquial term "printing ink", but also in particular low viscosity coloring fluids such as "inks", in particular inkjet inks, and powdered coloring fluids such as toner, in addition to these higher viscosity coloring fluids. Thus, in the above and in the following, when printing fluids and/or inks and/or printing inks are discussed, this also includes colorless coating media, in particular. When printing fluids and/or inks and/or printing inks are discussed in the above and in the following, media used in pretreating (precoating) the printing substrate 02 are preferably meant. As an alternative to the term printing fluid, the term coating medium is to be understood as synonymous.

A printing machine 01 is understood here as a machine that applies or is capable of applying at least one printing fluid to a printing substrate 02. A printing machine 01 preferably has at least one printing substrate source 100, preferably at least one first printing unit 200, preferably at least one first means for promoting drying, i.e. one first supplementary drying means 301, e.g. a first dryer 301, and preferably has at least one post-processing device 500. The printing machine 01 may optionally have at least one second printing unit 400, for example, and at least one second means for promoting drying, for example, i.e. supplementary drying means 331, e.g. a second dryer 331. Printing machine 01 is preferably embodied as an inkjet printing machine 01. Preferably, printing machine 01 is embodied as a web-fed printing machine 01, more preferably as a web-fed inkjet printing machine 01. Printing machine 01 can be embodied as a printing machine 01 that operates solely by the inkjet method, or where appropriate alongside other non-impact and/or printing forme-based methods. The at least one first printing unit 200 is preferably embodied as at least one first inkjet printing unit 200.

In the case of a web-fed printing machine 01, printing substrate source 100 is embodied as a roll unwinding device 100. In the case of a sheet-fed printing machine or rotary sheet-fed printing machine, printing substrate source 100 is embodied as a sheet feeder. In printing substrate source 100, at least one printing substrate 02 is preferably aligned, preferably at least with respect to one edge of said printing substrate 02. In the roll unwinding device 100 of a web-fed printing machine 01, at least one web-type printing substrate 02, i.e. a printing substrate web 02, preferably a paper web 02 or a textile web 02 or a foil 02, for example a plastic foil 02 or a metal foil 02, is unwound from a printing substrate roll 101, and is preferably aligned with respect to its edges in an axial direction A or a transverse direction A. Axial direction A is preferably a direction A that extends parallel to a rotational axis of a printing substrate roll 101 in the transverse direction A. Transverse direction A is preferably a horizontally extending direction A. Transverse direction A is oriented orthogonally to a transport direction T provided for the transport of web-type printing substrate 02, in particular, and/or orthogonally to a transport path provided for the printing substrate 02 through the at least one first printing unit 200. The transport path provided for transport of the at least one printing substrate 02, more particularly of the printing substrate web 02, preferably extends from the at least one printing substrate source 100 through the at least one first printing unit 200, where the printing substrate 02, and in particular the printing substrate web 02, is provided with a printed image, preferably by means of at least one printing ink, on at least one side, and preferably on both sides in conjunction with the at least one second printing unit 400.

In the case of a curved transport path, transport direction T is preferably the direction that runs tangentially to the section of and/or point on the provided transport path that is closest to a given reference point. This given reference point preferably lies at the point and/or on the component that is correlated to transport direction T.

In the following, the invention will be described in the context of an inkjet printing machine 01. However, the invention may also be used for other non-impact printing methods or for entirely different printing methods, such as rotary printing, offset printing, lithographic printing, letterpress printing, screen printing and intaglio printing, for example, provided such use does not result in inconsistencies. In the following, the invention will be described in connection with a web-type printing substrate 02, i.e. a printing substrate web 02. However, corresponding features can preferably be likewise applied to printing machines 01 for use with sheet-type printing substrate 02, provided such use does not result in inconsistencies. Printing machine 01 is preferably embodied as a web-fed printing machine 01, more preferably as a web-fed inkjet printing machine 01. Printing machine 01 is embodied, for example, as a rotary printing machine 01, for example as a web-fed rotary printing machine 01, in particular as a web-fed rotary inkjet printing machine 01.

After passing through the at least one first printing unit 200, the transport path provided for printing substrate 02, and more particularly for printing substrate web 02, preferably passes through the at least one first dryer 301 to dry the printing ink that has been applied. The at least one first dryer 301 is preferably part of a dryer unit 300. After passing through the at least one first dryer 301 and preferably through the at least one second printing unit 400 and/or the at least one second dryer 331, printing substrate 02, more particularly printing substrate web 02, is preferably fed to the at least one post-processing device 500, where it is further processed. The at least one post-processing device 500 is embodied, for example, as at least one folding device 500 and/or as a winding device 500 and/or as at least one flat delivery unit 500. In the at least one folding device 500, the printing substrate 02, which has preferably been printed on two sides, is further processed to form individual printed products, for example.

Along the transport path of printing substrate 02, more particularly of printing substrate web 02, through printing machine 01, at least the first dryer 301 is preferably located downstream of the at least one first printing unit 200, and/or at least the second printing unit 400 is preferably located downstream of the at least one first dryer 301, and/or the at least one second dryer 331 is preferably located downstream of the at least one second printing unit 400, and/or the at least one post-processing device 500 is preferably located downstream of the at least one second dryer 331. This ensures that a high-quality two-sided printing of the printing substrate 02, more particularly of the printing substrate web 02, is possible.

The working width of printing machine 01 is a dimension that preferably extends orthogonally to the transport path provided for printing substrate 02 through the at least one first printing unit 200, and/or horizontally, more preferably in axial direction A or transverse direction A. The working width of printing machine 01 is preferably equal to the maximum width a printing substrate 02 may have for processing by the printing machine 01 and/or by the at least one first printing unit 200, i.e. the maximum printing substrate width that can be processed by printing machine 01.

Roll unwinding device 100 preferably has at least one roll holding device 103 per storage position, said device being embodied as a chucking device 103 and/or as a clamping device 103, for example. The at least one roll holding device 103 preferably has at least one drive motor 104, in particular one electric motor 104.

Downstream of roll holding device 103 along the transport path for printing substrate web 02, roll unwinding device 100 preferably comprises a dancer roller, mounted on a dancer lever 121 such that said roller can be pivoted outward, and/or a first web edge aligner 114, and/or an infeed nip 119 formed by a draw roller 118 and an impression draw roller 117, and an infeed unit 139 having a first measuring roller 141. Said draw roller 118 preferably has a dedicated drive motor 146, embodied as a pulling drive motor 146. Downstream of the first web edge aligner 114, infeed unit 139 is preferably located. Draw roller 118, which is preferably mounted such that it cooperates with impression drawing roller 117 to form infeed nip 119, is preferably provided as a component of infeed unit 139.

Infeed nip 119 serves to regulate web tension and/or to transport printing substrate 02. Web tension is preferably measurable by means of the at least one first measuring roller 141. The at least one first measuring roller 141 is preferably located upstream of infeed nip 119 in transport direction T of printing substrate web 02.

The first printing unit 200 is located downstream of roll unwinding device 100 with respect to the transport path of printing substrate 02. The first printing unit 200 preferably has at least one printing substrate guide element 201, embodied, for example, as at least one first central printing cylinder 201, or central cylinder 201 for short. In the following, when a central cylinder 201 is mentioned, a central printing cylinder 201 is always meant. During printing operation, printing material web 02 wraps at least partially around the first printing substrate guide element 201, more particularly the first central cylinder 201. The wrap angle in such cases is preferably at least 180° and more preferably at least 270°. It is likewise possible, however, for smaller wrap angles and/or a different number of printing substrate guide elements 201 to be provided, for example to create rectilinear transport sections in the region of a printing line. It is also possible, in particular, for printing substrate 02 to be transported via at least one conveyor belt.

At least one second measuring roller 216 for measuring web tension is preferably located upstream of the first central cylinder 201 of the first printing unit 200, along the transport path of printing substrate web 02. At least one first printing substrate preparation device 202 or web preparation device 202 is preferably located upstream of the first central cylinder 201 of the first printing unit 200 along the transport path of printing substrate web 02, and aligned with the transport path provided for printing substrate web 02. The at least one first printing substrate preparation device 202 is preferably embodied as at least one printing substrate cleaning device 202 or web cleaning device 202. Alternatively or additionally, the at least one printing substrate preparation device 202 is embodied as at least one coating device 202, in particular for water-based coating media. Such a coating acts, for example, as an undercoating (primer). Alternatively or additionally, the at least one printing substrate preparation device 202 is embodied as at least one corona device 202 and/or discharge device 202 for corona treatment of the printing substrate 02.

A roller 203 embodied as first deflecting roller 203 of the first printing unit 200 is preferably disposed with its axis of rotation parallel to the axis of rotation 111 of the first central cylinder 201. This first deflecting roller 203 is preferably located spaced apart from the first central cylinder 201. More particularly, a first intermediate space 204 that is greater than the thickness of printing substrate web 02 is preferably formed between the first deflecting roller 203 and the first central cylinder 201. The thickness of printing substrate web 02 is understood as the smallest dimension of printing substrate web 02. Printing substrate web 02 preferably wraps around part of the first deflecting roller 203 and is deflected by said roller in such a way that the transport path of printing substrate web 02 in the first intermediate space 204 extends both tangentially to the first deflecting roller 203 and tangentially to the first central cylinder 201. The lateral surface of deflecting roller 203 is preferably made of a relatively inelastic material, more preferably a metal, even more preferably steel or aluminum.

At least one first cylinder 206, embodied as a first impression cylinder 206, is preferably provided in the first printing unit 200. The lateral surface of the first impression cylinder 206 is preferably made of an elastic material, for example an elastomer. The first impression cylinder 206 can preferably be thrown onto the first central cylinder 201 by means of an adjustment drive and preferably cooperates with the first central cylinder 201 to form a first impression nip 209. The first central cylinder 201 preferably has a dedicated first drive motor 208, preferably embodied as an electric motor 208 and more preferably as a direct drive 208 and/or a separate drive 208.

On the first drive motor 208 of the first central cylinder 201 and/or on the first central cylinder 201 itself, a first angular position sensor is preferably provided, which is configured to measure and/or be capable of measuring the angular position of the first drive motor 208 and/or of the first central cylinder 201 itself, and to transmit and/or be capable of transmitting this angular position measurement to a higher-level machine controller. The first angular position sensor is embodied as a rotary encoder or absolute value encoder, for example. Such an angular position sensor can preferably be used to determine in absolute terms the angular position of the first drive motor 208 and/or preferably the angular position of the first central cylinder 201, preferably by means of the higher-level machine controller. Additionally or alternatively, the first drive motor 208 of the first central cylinder 201 is connected in terms of circuitry to the machine controller in such a way that the machine controller is informed at all times of the angular position of the first drive motor 208 and thus at the same time of the angular position of the first central cylinder 201, based upon setpoint data regarding the angular position of the first drive motor 208 specified for the first drive motor 208 of the first central cylinder 201 by the machine controller. More particularly, a region of the machine controller that specifies the rotational angle position or angular position of the first central cylinder 201 and/or of the first drive motor 208 is preferably connected directly, in particular without an interposed sensor, to a region of the machine controller that controls at least one print head 212 of the first printing unit 200.

Within the first printing unit 200, at least one first printing element 211 is preferably provided. The at least one first printing element 211 is, more particularly, a first printing couple 211. The at least one first printing element 211 is preferably embodied as a first inkjet printing element 211. The first printing element 211 preferably has at least one nozzle bar 213, and more preferably has a plurality of nozzle bars 213, in particular four. A nozzle bar 213 in this context is a component that preferably extends over at least 80% and more preferably at least 100% of the working width of printing machine 01 and serves as a support for the at least one print head 212. The at least one nozzle bar 213 is preferably formed at least partially by at least one, in particular first supporting body 616; 636; 637; 638 on which, more preferably, at least one image-generating device 212 is mounted, preferably at least one print head 212, more preferably at least one inkjet print head 212. On the at least one, in particular first supporting body 616; 636; 637; 638, a plurality of first image-generating devices 212 are preferably mounted, more preferably arranged offset relative to one another with respect to transverse direction A and/or spaced apart from one another. For example, on the at least one, in particular first supporting body 616; 636; 637; 638, at least two, more preferably at least five, and even more preferably at least ten first image-generating devices 212 are mounted, more preferably arranged offset relative to one another with respect to transverse direction A and/or spaced apart from one another.

The at least one supporting body 616 preferably has at least one bottom segment 624. The at least one bottom segment 624 further preferably serves to support the individual image-generating devices 212, in particular print heads 212. The following description is based on a print head 212 as an image-generating device 212, by way of example. Wherever a print head 212 is mentioned in the above and/or in the following, however, this is intended to include any image-generating device 212 in general, provided no inconsistencies result from such inclusion. For this purpose, the at least one bottom segment 624 has, for example, one or more print head openings 626, for example one print head opening 626 per print head 212. The at least one print head opening 626 preferably opens the at least one bottom segment 624 up in a direction having at least one component pointing vertically downward, and/or in an adjustment direction of the respective print head 212 and/or nozzle bar 213 and/or supporting body 616; 636; 637; 638.

Preferably, the at least one print head 221 is situated protruding at least partially through the at least one print head opening 626.

The at least one first printing element 211 and thus the at least one first printing unit 200 preferably includes the at least one first print head 212, embodied in particular as an inkjet print head 212. Each at least one nozzle bar 213 preferably includes at least one print head 212, each such nozzle bar more preferably including a plurality of print heads 212, in particular arranged offset relative to one another with respect to transverse direction A and/or spaced apart from one another. Each print head 212 preferably has a plurality of nozzles from which ink droplets are and/or can be ejected. The axial length of the body of the at least one first central cylinder 201 is preferably at least as great as the working width of the printing machine 01. At least one such nozzle bar 213 is preferably provided per printing element 211, with a plurality of nozzle bars 213 more preferably being provided per printing element. Each nozzle is preferably assigned a clearly defined target area over the widthwise direction of the printing substrate web 02, parallel to axial direction A, and preferably with respect to the axial direction A in particular of the rotational axis 207 of the at least one printing substrate guide element 201, embodied in particular as first central cylinder 201.

Each target area of a nozzle is preferably clearly defined, at least during a printing operation, in particular with respect to the transport direction T provided for printing substrate 02 and/or with respect to a longitudinal direction B. The longitudinal direction B is preferably oriented horizontally and oriented orthogonally to axial direction A or transverse direction A. For example, each target area of a nozzle is clearly defined, at least during a printing operation, in particular with respect to the circumferential direction of the at least one first central cylinder 201. The target area of a nozzle is, in particular, the substantially rectilinear spatial area that extends outward from said nozzle in the direction of ejection from said nozzle. Ejection directions of nozzles of a common print head 212 are preferably aligned parallel to one another. The ejection direction of at least one nozzle of the at least one print head 212 is preferably aligned toward the lateral surface of the at least one printing substrate guide element 201; 401, at least when said print head 212 is disposed in a printing position.

The at least one first nozzle bar 213 preferably extends parallel to transverse direction A and/or orthogonally to longitudinal direction B and/or to the transport path of printing substrate 02 over the working width of printing machine 01. More particularly, the at least one supporting body 616; 636; 637; 638 preferably extends parallel to transverse direction A and/or orthogonally to longitudinal direction B and/or to the transport path of printing substrate 02 over at least 80% and more preferably at least 100% of the working width of printing machine 01. The at least one nozzle bar 213 preferably has a multiplicity of nozzles. The nozzles of this multiplicity are preferably arranged spaced at regular intervals from one another as viewed in transverse direction A, and/or preferably have nozzle openings spaced at regular intervals over the entire working width of printing machine 01 and/or of the first printing unit 200. The nozzles of this multiplicity are preferably distributed as viewed in transverse direction A in such a way that coating medium can be ejected over the entire working width of printing machine 01 and/or of the first printing unit 200.

In one embodiment, a single continuous print head 212 is provided for this purpose, extending in transverse direction A over the entire working width of printing machine 01 and/or of the first printing unit 200. In another, preferred embodiment, a plurality of print heads 212 are arranged side by side in the transverse direction A on the at least one nozzle bar 213, more particularly on the relevant supporting body 616; 636; 637; 638. Since such individual print heads 212 typically are not equipped with nozzles up to the edge of their housing, at least two and more preferably precisely two rows of print heads 212 extending in transverse direction A are preferably arranged offset from one another in the transport direction T of printing substrate 02 and/or in longitudinal direction B and or in the circumferential direction with respect to the first central cylinder 201, more preferably in such a way that successive print heads 212 in transverse direction A preferably belong alternately to one of the at least two rows of print heads 212, in particular alternating between a first and a second of two rows of print heads 212. Every two such rows of print heads 212 preferably together form a double row of print heads 212. The multiplicity of nozzles preferably is not configured as a single linear succession of nozzles, and instead results from the sum of a plurality of individual rows of nozzles, more preferably two such rows, arranged offset from one another in the circumferential direction.

If a print head 212 has a plurality of nozzles, then all the target areas of the nozzles of that print head 212 together form the working zone of said print head 212. Working zones of print heads 212 of a nozzle bar 213, and in particular of a double row of print heads 212, adjoin one another as viewed in transverse direction A and/or overlap one another as viewed in transverse direction A. This ensures that, even if print head 212 is not continuous in transverse direction A, target areas of nozzles of the at least one nozzle bar 213 and/or more particularly of the double row of print heads 212 in question are located at regular and preferably periodic intervals as viewed in transverse direction A. In any case, the entire working zone of the at least one nozzle bar 213 preferably extends over at least 90% and more preferably 100% of the working width of printing machine 01 and/or over the entire width of the body of the at least one first central cylinder 201 in transverse direction A. On one or on both sides with respect to axial direction A, a narrow region of printing substrate web 02 and/or of the body of the first central cylinder 201 that does not belong to the working zone of nozzle bar 213 may be present. An entire working zone of the at least one nozzle bar 213 is preferably composed of all the working zones of print heads 212 of said at least one nozzle bar 213, and is preferably composed of all the target areas of nozzles of these print heads 212 of said at least one nozzle bar 213. An entire working zone of a double row of print heads 212 preferably corresponds to the working zone of the at least one nozzle bar 213 as viewed in axial direction A.

The at least one nozzle bar 213 preferably has a plurality of rows of nozzles as viewed in transport direction T of printing substrate 02 and/or in longitudinal direction B and/or in the circumferential direction with respect to the at least one first central cylinder 201. Each print head 212 preferably has a plurality of nozzles, more preferably arranged in a matrix of a plurality of rows, substantially in transverse direction A, and/or a plurality of columns, preferably substantially in transport direction T of printing substrate 02, and/or in longitudinal direction B, and/or in the circumferential direction of the at least one first central cylinder 201. More preferably, such columns are arranged extending obliquely to said transport direction T or longitudinal direction B or circumferential direction, to increase the achievable resolution of a printed image, for example. Preferably, a plurality of rows of print heads 212, more preferably four double rows and even more preferably, eight double rows of print heads 212, are arranged one behind the other in a direction orthogonal to axial direction A, in particular in transport direction T along the transport path of printing substrate 02 and/or in longitudinal direction B and/or in the circumferential direction with respect to the at least one central cylinder 201. More preferably, at least during printing operation, a plurality of rows of print heads 212, more preferably four double rows and still more preferably eight double rows of print heads 212, are arranged one behind the other on the at least one first central cylinder 201, aligned in the circumferential direction with respect to the at least one first central cylinder 201.

In addition, at least during printing operation, print heads 212 are preferably aligned such that the nozzles of each print head 212 point substantially orthogonally toward a transport path provided for printing substrate 02 and/or, in particular, in a substantially radial direction toward the lateral cylinder surface of the at least one first central cylinder 201. Deviations of orthogonal directions within a tolerance range of preferably at most 10° and more preferably at most 5° should be considered substantially orthogonal directions. Deviations of radial directions within a tolerance range of preferably at most 10° and more preferably at most 5° should be considered substantially radial directions. Said radial direction is a radial direction with respect to the rotational axis 207 of the at least one first central cylinder 201. A printing ink of a specific color, for example one of the colors black, cyan, yellow and magenta, or a varnish, for example a clearcoat varnish, or a medium used for pretreating the printing substrate, for example a primer, preferably is and/or can be assigned to each double row of print heads 212. The corresponding inkjet printing element 211 is preferably embodied as a four-color printing element 211 and enables, in particular, one-sided four-color printing of printing substrate web 02. It is also possible to print with more or with fewer different colors, for example additional special colors, using one printing element 211. In that case, a correspondingly greater or smaller number of print heads 212 and/or double rows of print heads 212 are arranged within this corresponding printing element 211. In one embodiment, at least during printing operation, and preferably within the first printing unit 200, a plurality of rows of print heads 212, more preferably four double rows, and even more preferably eight double rows of print heads 212, are arranged one behind the other, aligned toward at least one surface of at least one transfer body, for example at least one transfer cylinder and/or at least one transfer belt.

The at least one print head 212 preferably works to generate droplets of printing ink by the drop-on-demand method, in which printing ink droplets are generated selectively as needed. At least one piezoelectric element is preferably used per nozzle, which is capable of reducing a volume filled with printing ink by a certain percentage at high speed when a voltage is applied. This causes printing ink to be displaced and ejected through a nozzle connected to the volume that is filled with printing ink, forming at least one droplet of printing ink. By applying different voltages to the piezoelectric element, the actuating path of the piezoelectric element and as a result the reduction in the volume and thus the size of the printing ink droplets can be influenced. This allows color gradations to be achieved in the resulting printed image, without altering the number of droplets used to produce the printed image (amplitude modulation). It is also possible to use at least one heating element per nozzle, which generates a gas bubble at high speed in a volume filled with printing ink by vaporizing the printing ink. The additional volume of the gas bubble displaces printing ink, which is in turn ejected through the corresponding nozzle, forming at least one droplet of printing ink.

In the drop-on-demand method, the target position of a droplet of printing ink on the moving printing substrate web 02 with respect to longitudinal direction B and/or transport direction T and/or the circumferential direction of the at least one first central cylinder 201 is defined based solely on the ejection time of said printing ink droplet and the transport speed of the printing substrate 02 and/or the rotational speed of the first central cylinder 201 and/or based solely on the position of the printing substrate 02 and/or the angular position of the first central cylinder 201. Actuating each nozzle individually allows printing ink droplets to be transferred from the at least one print head 212 to the printing substrate web 02 only at selected times and at selected locations. This is preferably carried out based on the transport speed of printing substrate 02 and/or the position of printing substrate 02, and thus more preferably based on the rotational speed and/or the angular position of the at least one first central cylinder 201. This is furthermore carried out based on the distance between the nozzle in question and the printing substrate web 02 and based on the position of the target area of the nozzle in question with respect to the provided transport path and/or the circumferential angle of the first central cylinder 201. This results in a desired printed image, produced based on the actuation of all the nozzles.

Ink droplets are preferably ejected from the at least one nozzle of the at least one print head 212 based on the angular position of the at least one drive motor, for example the first drive motor 208, as specified by the machine controller. The target data regarding the angular position of the drive motor, in particular the first drive motor 208, as specified to said drive motor, in particular first drive motor 208, by the machine controller, are preferably incorporated in real time into a calculation of data for actuating the nozzles of the at least one print head 212. A comparison with actual data regarding the angular position of the drive motor 208 in question is preferably unnecessary, and preferably is not carried out. A precise and constant positioning of printing substrate 02 relative to the component that is driven by the corresponding drive motor, i.e. more particularly, a precise and constant positioning of printing substrate web 02 relative to the at least one first central cylinder 201, is therefore critical for producing a printed image with accurate color registration and/or register. Also critical, however, is a precise and constant positioning of the print heads relative to the transport path provided for printing substrate 02 and in particular relative to the first central cylinder 201.

The nozzles of the at least one print head 212, at least when said print head 212 is disposed in a printing position, are preferably arranged such that the distance between the nozzles and the printing substrate web 02, in particular the printing substrate web 02 disposed on the lateral cylinder surface of the at least one first central cylinder 201, is preferably between 0.5 mm and 5 mm and more preferably between 1 mm and 1.5 mm. The high angular resolution and/or the high scanning frequency of the first rotational angle sensor and/or the high precision of the setpoint data regarding the angular position of the first drive motor 208 of the first central cylinder 201, as specified by the machine controller and processed by the first drive motor 208 of the first central cylinder 201, enable a highly precise position determination and/or knowledge of the positioning of printing substrate web 02 in relation to the nozzles and the target areas thereof. The droplet flight time between the nozzles and printing substrate web 02 is known, for example, from a learning process and/or from the known distance between the nozzles and printing material web 02 combined with a known droplet speed. The positioning of printing substrate web 02 and/or the angular position of the at least one first central cylinder 201 and/or the angular position of the corresponding drive motor, in particular the first drive 208 of the at least one first central cylinder 201, the transport speed of printing substrate 02 and/or the rotational speed of the at least one first central cylinder 201, and the droplet flight time are used to determine the ideal time for ejection of each droplet, so that printing material web 02 will be imprinted with accurate color registration and/or true to register.

During regular printing operation, the goal is for all print heads 212 to be stationary. This ensures a consistently accurate color registration and/or register-true alignment of all nozzles. Various situations are conceivable in which a movement of the print heads 212 might be necessary. A first such situation is a flying roll change or generally a roll change that involves a splicing process. A joining area that is produced in such a process is substantially the same thickness as two printing substrate webs 02 plus the splicing strip. The at least one nozzle bar 213 can therefore be moved in at least one adjustment direction and/or along at least one adjustment path relative to the transport path provided for printing substrate 02 and/or relative to the rotational axis 207 of the at least one first central cylinder 201. This allows the spacing to be increased sufficiently;

however, it must be decreased again accordingly afterward. A second such situation arises, for example, during maintenance and/or cleaning of at least one of print heads 212. Print heads 212 are preferably attached individually to the at least one nozzle bar 213 and can be removed individually from the at least one nozzle bar 213. This allows individual print heads 212 to be maintained and/or cleaned and/or replaced. It is preferably alternatively or additionally possible for each entire nozzle bar 213 to be moved in the adjustment direction away from the transport path provided for printing substrate 02 and/or away from the first central cylinder 201 far enough that a maintenance device 222 and/or cleaning device 222 and/or inspection device 222 can be used on the nozzle surfaces of print heads 212. An appropriate positioning device 217; 218; 219; 221 is preferably used for this purpose.

The at least one print head 212; 412 is preferably connected and/or connectable to at least one positioning device 217; 218; 219; 221. More preferably, the at least one print head 212 is permanently connected to the at least one positioning device 217; 218; 219; 221 and can be separated from the at least one positioning device 217; 218; 219; 221 only for the purpose of installation and/or removal and/or for replacement of the at least one print head 212. The at least one printing unit 200; 400 preferably has at least two and more preferably at least four nozzle bars 213; 413, each having at least two print heads 212; 412. Each nozzle bar 213; 413 is preferably connected and/or connectable to at least one positioning device 217; 218; 219; 221, thereby ensuring that each corresponding print head 212; 412 is simultaneously connected and/or connectable to at least one positioning device 217; 218; 219; 221. Each of the at least two, in particular at least four nozzle bars 213; 413 is preferably mounted such that it can move along a linear adjustment path, for example, by means of a respective positioning device 217; 218; 219; 221. Preferably, at least one of at least two print heads 212 can be selectively placed at least either in a printing position assigned to it or in at least one idle position assigned to it, more preferably by means of a positioning device 217 assigned to it. More preferably, each of at least four print heads 212; 412 can be selectively placed at least either in a printing position assigned to it or in at least one idle position assigned to it, more preferably by means of a positioning device 217; 218; 219; 221 assigned to it. Preferably, the at least one print head 212 can be placed in at least one idle position and more preferably in at least two different idle positions, in particular by means of the at least one positioning device 217; 218; 219; 221. The at least one idle position is embodied, for example, as at least one maintenance position and/or as at least one installation position.

In one exemplary embodiment of the at least one positioning device 217; 218, 219; 221, the at least one positioning device 217; 218, 219; 221 has at least one linear positioning guide 224, preferably embodied as a rail 224, and more preferably has a plurality of positioning guides 224, in particular four, preferably embodied as rails 224, and even more preferably has at least one positioning guide 224, preferably embodied as a rail 224, per movable nozzle bar 213 and/or per movable print head 212. More preferably, two positioning guides 224 embodied as rails 224 are provided per nozzle bar 213, in particular with one rail 224 at each end of the at least one printing substrate guide element 201; 401 in the transverse direction A, i.e. a total of at least eight rails 224 per printing unit 200; 400. The adjustment path of the at least one print head 212; 412 and/or nozzle bar 213; 413 is preferably configured as linear, in particular when the at least one positioning guide 224 is embodied as at least one rail 224.

Preferred, therefore, is a printing machine 01 that comprises at least one printing unit 200; 400 having at least two, more preferably at least three, and even more preferably at least four print heads 212; 412, and preferably has at least one printing substrate guide element 201; 401 that is rotatable about a rotational axis 207; 407, wherein each of the at least two, preferably at least three, and more preferably at least four print heads 212; 412 is mounted such that it can be moved along a respective linear adjustment path by means of a respective positioning device 217; 218; 219; 221 assigned at least to said print head 212; 412. The linear adjustment paths more preferably point in respective adjustment directions that differ in pairs by at least 10°, more preferably by at least 15°, and independently of the lower limit, differ by at most 150°, more preferably by at most 120°, even more preferably by at most 90° and more preferably still by at most 60°. Preferably, all the adjustment directions of positioning devices 217; 218; 219; 221 of the same printing unit 200; 400 differ in all possible paired comparisons by at least 10°, more preferably by at least 15°, and independently of the lower limit, differ by at most 150°, more preferably by at most 120°, even more preferably by at most 90°, and more preferably still by at most 60°. Adjustment directions of print heads 212; 412 that are assigned to adjacent positioning devices 217; 218, 219; 221 preferably differ by at least 10°, more preferably by at least 15°, and independently of the lower limit, differ by at most 60°, more preferably by at most 45°, even more preferably by at most 30°, and more preferably still by at most 20°. Preferably, it is ensured that movements of the at least one print head 212 and/or nozzle bar 213 occur only within a plane defined by a surface normal that is positioned parallel to transverse direction A, in particular within an axial projection plane.

Each of the at least two, preferably at least three, and more preferably at least four print heads 212; 412 can preferably be placed selectively, by means of the respective positioning device 217; 218; 219; 221, at least either in a printing position assigned to it or in at least one maintenance position assigned to it, wherein in the at least one maintenance position of a first print head 212; 412 of the at least two, preferably at least three, and more preferably at least four print heads 212; 412, at least one maintenance device 222 is and/or can be assigned to at least one first nozzle of the at least one first print head 212; 412. The description referring above and in the following to the at least one maintenance device 222 applies preferably to every maintenance device 222, including in particular cases in which two, three, or four maintenance devices are provided per printing unit 200; 400. The at least one maintenance device 222 is preferably mounted such that it can be moved along at least one deployment path between at least one parking position and at least one operating position, in particular by means of at least one transport device 223. If a plurality of maintenance devices 222 is provided, each maintenance device 222 is preferably assigned its own deployment path, its own parking position, and its own operating position. One possible component of the deployment path of each at least one maintenance device 222, extending in an axial direction A that is defined by the rotational axis 207; 407 of the at least one rotatable printing substrate guide element 201; 401, is preferably no more than 50% of the width, measured in the axial direction A, of the working zone of the nozzle bar 213 that includes the at least one print head 212, and/or no more than 50% of the working width of printing machine 01, defined by the maximum printing substrate width that can be processed by printing machine 01.

The at least one nozzle bar 213 is preferably movable completely independently of components of printing machine 01 that are disposed touching the printing substrate web 02 and/or forming a tangent to the transport path provided for printing substrate 02. This allows cleaning and/or maintenance to be performed, without influencing printing substrate web 02, more particularly, without having to remove printing substrate web 02 from printing machine 01.

Regardless of whether or not a positioning device 217; 218; 219; 221 is provided, the at least one nozzle bar 213 preferably has at least one first supporting body 616. More preferably, the entire set of nozzle bars 213 preferably has a plurality of supporting bodies 616; 636; 637; 638. For example, each nozzle bar 213 has precisely one supporting body 616; 636; 637; 638. Each of these supporting bodies 616; 636; 637; 638 preferably has at least one bottom segment 624, which, as described above, preferably has print head openings 626, in particular a plurality of print head openings 626. In addition, the at least one supporting body 616; 636; 637; 638 preferably has at least one side stanchion 681, extending, for example, at least in the adjustment direction, and/or at least vertically, and/or at least orthogonally to transport direction T and/or at least radially to rotational axis 111 of central cylinder 201. The at least one supporting body 616; 636; 637; 638 preferably has at least two such side stanchions 681, which more preferably are connected to one another via at least one cross member 682. The at least one cross member 682 preferably extends at least horizontally, and more preferably at least in transverse direction A, and/or at least partially and preferably completely parallel to the at least one respective bottom segment 624. The at least one supporting body 616; 636; 637; 638 is preferably connected via the at least one positioning guide 217; 218; 219; 221, more preferably embodied as rail 224, to the frame 283 of printing unit 200, and is even more preferably mounted movably relative to said frame 283, at least in the adjustment direction.

At least one temperature control device 641; 642; 643; 644; 646; 647; 648; 649 is preferably located on the at least one supporting body 616; 636; 637; 638. The at least one temperature control device 641; 642; 643; 644; 646; 647; 648; 649 serves to induce and/or maintain deflections of the at least one supporting body 616; 636; 637; 638 in a controlled manner, for example, and/or to compensate for undesirable deflections of the at least one supporting body 616; 636; 637; 638.

Preferred is a printing unit 200 in which the at least one transport direction T is defined by a transport path provided for transporting printing substrate 02 through printing unit 200, and in which printing unit 200 has at least one first supporting body 616, on which at least one first image-generating device 212, in particular at least one print head 212, is mounted. The at least one first supporting body 616 preferably extends both in the transport direction T, more particularly in the transport direction T at a point along the intended transport path that is closest to this first supporting body 616, and in the transverse direction A oriented horizontally and orthogonally to transport direction T. Printing unit 200 preferably comprises the at least one, in particular first temperature control device 641; 642 for the targeted generation of a temperature difference between a first point 651 on said at least one first supporting body 616 and a second point 652 on said at least one first supporting body 616, said second point being spaced apart from said first point 651, at least in transport direction T.

A temperature difference between two points 651; 652 on a component 616, in particular on the at least one first supporting body 616 or on another supporting body 636; 637; 638, said points being spaced apart from one another, at least in transport direction T, results in different relative expansions of said component 616, for example at these points 651; 652, in particular on this first or respective supporting body 616; 636; 637; 638, in the transverse direction A. This results in a sagging of this component 616, in particular of this first supporting body 616. This sagging causes parts of this component 616, in particular this first supporting body 616, that are not stationary relative to frame 283, to be displaced and/or shifted at least in and/or opposite transport direction T. The direction of displacement is determined from the direction of a connection between the first point 651 and the second point 652. For example, two ends of the at least one component 616, in particular of the first supporting body 616, with respect to transverse direction A, and more preferably two ends of each supporting body 616; 636; 637; 638 with respect to transverse direction A, are stationary relative to frame 283 of first printing unit 200. This stationary relative disposition exists at least during a printing operation and/or while positioning device 217; 218; 219; 221 is idle, and even when positioning device 217; 218; 219; 221 is moving, said disposition exists at least in that the ends of supporting body 616; 636; 637; 638 are secured, while the center portion of the supporting body can be moved by deflection. If a temperature difference causes a deflection of the supporting body 616; 636; 637; 638 as described, at least one center portion of said supporting body 616; 636; 637; 638 with respect to transverse direction A will be displaced in the direction of the sagging, i.e. in the direction of the temperature difference. This direction preferably points in or opposite transport direction T. More particularly, the direction of displacement of the sagging points from a cooler side to a warmer side.

An image-generating device 212 located centered on said supporting body 616; 636; 637; 638 with respect to transverse direction A, more particularly a print head 212 located centered on said supporting body 616; 636; 637; 638 with respect to transverse direction A, will thereby experience only minimal displacement. Image-generating devices 212, in particular print heads 212, that are located further toward the outside with respect to axial direction A experience less displacement due to a substantially arcuate deflection of the relevant supporting body 616; 636; 637; 638. The targeted generation of an appropriately selected temperature difference enables a targeted displacement of print heads 212 to be achieved, for example to compensate for color registration errors and/or register errors that would otherwise occur, more particularly without having to adjust the actuation times of corresponding print heads 212. This is possible, in particular, even during an ongoing printing operation.

Printing unit 200 is preferably alternatively or additionally characterized in that the at least one first supporting body 616 extends in transverse direction A over at least 80% and more preferably at least 100% of the working width of printing unit 200, and/or in that the at least one first temperature control device 641; 642 extends in transverse direction A over at least 10%, more preferably at least 20% and even more preferably at least 50% of the working width of printing unit 200, and/or in that the at least one first temperature control device 641; 642 extends in transverse direction A over at least twice the width of an image-generating device 212 embodied, in particular, as print head 212. The same preferably applies similarly to at least one second supporting body 636 and/or at least one temperature control device 643; 644 located on the second supporting body 636. The same preferably applies similarly to at least one third supporting body 637 and/or at least one temperature control device 646; 647 located on the third supporting body 637. The same preferably applies similarly to at least one fourth supporting body 638 and/or at least one temperature control device 648; 649 located on the fourth supporting body 638.

Printing unit 200 is preferably alternatively or additionally characterized in that a printing ink of a first color is assigned to the at least one first image-generating device 212, and a printing ink of a second color that is different from the first color is assigned to the at least one second image-generating device 212.

To enable optimal temperature control, in particular, the position and/or sagging of the supporting body 616; 636; 637; 638 in question is preferably measured. Printing unit 200 is preferably characterized in that it has at least one first position sensor 673 for determining the position, at least with respect to transport direction T, of a first reference point 661, located on the first supporting body 616, in relation to another reference point 663; 671. This other reference point 663; 671 is stationary relative to a frame 283 of printing unit 200, for example, and/or stationary relative to a second supporting body 636 of printing unit 200 that supports at least one second image-generating device 212.

If this additional reference point 671 is stationary relative to frame 283, it is also referred to as the first fixed reference point 671. In this way, it can be ensured that the selection of ejection times for the nozzles of the at least one print head 212 located on the first supporting body 616 is based on the correct position of said print head 212 with respect to transport direction T. Ensuring this for all print heads 212 of printing unit 200, in particular, enables production of a high-quality print image. As described, the at least one image-generating device 212 is preferably but not necessarily embodied as print head 212, more particularly as inkjet print head 212.

If this other reference point 663 is stationary relative to a second supporting body 636 of printing unit 200 that supports at least one second image-generating device 212, it can be ensured that the selection of ejection times for the nozzles of the at least one print head 212 located on the first supporting body 616 and the selection of ejection times for the nozzles of the at least one print head 212 located on the second supporting body 636 are based on the correct relative positioning of these print heads 212 with respect to transport direction T. Ensuring this for all print heads 212 of printing unit 200, in particular, enables a high-quality print image to be produced by achieving an optimized registration or color register.

Printing unit 200 is preferably alternatively or additionally characterized in that at least one first temperature control device 641 is situated for the targeted introduction and/or removal of thermal energy at the first point 651, more particularly at a first point 651 on the first supporting body 616. Printing unit 200 is preferably alternatively or additionally characterized in that at least one second temperature control device 642 for the targeted introduction and/or removal of thermal energy at a second point 652, more particularly at a second point 652 on the first supporting body 616, is located spaced a distance from the first temperature control device 641, in particular at least with respect to transport direction T. This at least one first temperature control device 641 and/or this at least one second temperature control device 642 are preferably located on the at least one first supporting body 616. This should also be understood as meaning that the corresponding temperature control device 641; 642 is part of said supporting body 616. Alternatively, the temperature control device may be located spaced apart from the supporting body 616 and may act on said supporting body by means of a gas stream and/or irradiation. The corresponding temperature control device 641; 642 is situated not only for the targeted introduction and/or removal of thermal energy at the first point 651 or at the second point 652, but also for the targeted adjustment of the temperature at said first point 651 and/or second point 652, for example. The at least one first temperature control device 641 and the at least one second temperature control device 642 can preferably be actuated separately from one another. More preferably, however, a common actuator is provided.

In a first embodiment, on each of the at least one supporting bodies, in particular first supporting body 616; 636; 637; 638, only one first temperature control device 641; 643; 646; 648 is provided. Said device is preferably situated such that it can be used to achieve a temperature control of the at least one, in particular first supporting body 616; 636; 637; 638 in question, said temperature control being asymmetrical with respect to transport direction T. For example, the first supporting body 616 has a first temperature control device 641 only on a front boundary surface as viewed in transport direction T. To the extent that this first temperature control device 641 enables the introduction and removal of thermal energy, it can be used to influence a corresponding sagging in two opposite directions, in particular in and opposite transport direction T, in a targeted manner.

In a preferred second embodiment, at least one first temperature control device 641; 643; 646; 648 and at least one second temperature control device 642; 644; 647; 649 are preferably both located on the at least one, in particular first supporting body 616; 636; 637; 638. At least one first temperature control device 641 is preferably situated such that it acts and/or is capable of acting on the at least one first supporting body 616, and at least one second temperature control device 642 is preferably situated such that it acts and/or is capable of acting on the at least one first supporting body 616, and said at least one first temperature control device 641 is preferably situated upstream of the at least one second temperature control device 642 with respect to transport direction T such that it acts and/or is capable of acting on said first supporting body 616. More preferably, at least one first temperature control device 641 is located on the at least one first supporting body 616, and at least one second temperature control device 642 is located on said at least one first supporting body 616, and said at least one first temperature control device 641 is located upstream of the at least one second temperature control device 642 on said at least one first supporting body 616 with respect to transport direction T. Even more preferably, at least one first temperature control device 641 is located on a front boundary surface of the at least one first supporting body 616, as viewed in transport direction T, and at least one second temperature control device 642 is located on a rear boundary surface of said at least one first supporting body 616, as viewed in transport direction T. The same preferably applies similarly to the additional supporting bodies 636; 637; 638 and the temperature control devices 643; 644; 646; 647; 648; 649 thereof.

The at least one first temperature control device 641 is preferably embodied as at least one first heating device 641, in particular as at least one first wire heating element 641. The at least one second temperature control device 642 is preferably embodied as at least one second heating device 642, in particular as at least one second wire heating element 642. Alternatively or additionally, the at least one first temperature control device 641 has at least one fluid line for at least one temperature control fluid, and/or the at least one first heating device 641 has at least one Peltier element. Alternatively or additionally, the at least one second temperature control device 642 has at least one fluid line for at least one temperature control fluid, and/or the at least one second heating device 642 has at least one Peltier element. Alternatively or additionally, the at least one first temperature control device 641 and/or the at least one second temperature control device 642 is embodied as at least one cooling device, for example. Each temperature control device 641; 642; 643; 644; 646; 647; 648; 649 preferably extends over at least 10%, more preferably over at least 25%, even more preferably over at least 50% and even more preferably over at least 80%, and more preferably still over at least 100% of the extension of the respective supporting body 616; 636; 637; 638 in transverse direction A.

At least one controlling and/or regulating device 679 is preferably provided, said at least one controlling and/or regulating device 679 preferably being connected to the at least one first temperature control device 641 and/or to at least one first position sensor 673. More preferably, said at least one controlling and/or regulating device 679 is connected to additional temperature control devices 642; 643; 644; 646; 647; 648; 649 and/or to additional position sensors 674; 676; 677; 678. Even more preferably, said at least one controlling and/or regulating device 679 is connected to all the temperature control devices 642; 643; 644; 646; 647; 648; 649 of supporting body 616; 636; 637; 638 and/or to all the position sensors 674; 676; 677; 678 that measure or are capable of measuring the position of supporting body 616; 636; 637; 638.

Printing unit 200 is preferably additionally or alternatively characterized in that printing unit 200 comprises the at least one second supporting body 636, on which at least one second image-generating device 212 is located, and in that printing unit 200 comprises at least one additional, for example third temperature control device 643, in particular different from the first temperature control device 641, for the targeted generation of a temperature difference between a first point 653 on said at least one second supporting body 636 and a second point 654 on said at least one second supporting body 636, said second point being spaced apart from said first point 653 on said at least one second supporting body 636, at least in transport direction T. This enables the deflections of this second supporting body 636 to also be influenced in a targeted manner, similarly to the first supporting body 616. In particular, the second supporting body 636 is located spaced from the first supporting body 616, at least with respect to transport direction T, and/or the at least one second print head 212 is located spaced from the at least one first print head 212, at least with respect to transport direction T. At least one fourth temperature control device 644, more preferably similar in embodiment to the first and/or the second temperature control device 641; 642, is preferably assigned to the second supporting body 636.

The deflection of the first supporting body 616 and/or the deflection of the second supporting body 636 are influenced in a coordinated manner, for example. For this purpose in particular, printing unit 200 is characterized, for example, not only in that printing unit 200 has at least one second supporting body 636 on which at least one second image-generating device 212 is located, but also in that printing unit 200 has at least one first position sensor 673 for determining the position, at least with respect to transport direction T, of a first reference point 661 located on the first supporting body 616 in relation to a first fixed reference point 671, and in that the first fixed reference point 671 is stationary relative to frame 283 of printing unit 200, and in that printing unit 200 has at least one second position sensor 674 for determining the position, at least with respect to transport direction T, of a second reference point 662, located on the first supporting body 616, in relation to a third reference point 663, and in that the third reference point 663 is stationary in relation to the second supporting body 636 of printing unit 200.

A coordinated positioning, in particular, of the first supporting body 616 relative to the second supporting body 636 and/or vice versa is preferably carried out. This can occur independently of the position relative to frame 283 of the printing unit, for example. For this purpose in particular, printing unit 200 is preferably characterized not only in that printing unit 200 has at least one second supporting body 636 on which at least one second image-generating device 212 is located, but also in that printing unit 200 has at least one position sensor 674 for determining the position, at least with respect to transport direction T, of a second reference point 662, for example, located on the first supporting body 616, in relation to a third reference point 663, for example, and in that this third reference point 663, for example, is stationary in relation to the second supporting body 636 of printing unit 200.

Printing unit 200 more preferably also comprises a third supporting body 637 and a fourth supporting body 638. At least one third print head 212 is preferably located on the third supporting body 637. At least one fourth print head 212 is preferably located on the fourth supporting body 638. The third supporting body 637 is preferably located spaced apart, at least with respect to transport direction T, from the second supporting body 636 and from the first supporting body 616, and/or the at least one third print head 212 is preferably located spaced apart, at least with respect to transport direction T, from the at least one second print head 212 and from the at least one first print head 212. The fourth supporting body 638 is preferably located spaced apart, at least with respect to transport direction T, from the third supporting body 637 and from the second supporting body 636 and from the first supporting body 616, and/or the at least one fourth print head 212 is preferably located spaced apart, at least with respect to transport direction T, from the at least one third print head 212 and from the at least one second print head 212 and from the at least one first print head 212.

Preferably at least one, in particular fifth temperature control device 646, and further preferably at least one, in particular sixth temperature control device 647, which more preferably are similar in embodiment to the first and/or the second temperature control device 641; 642, are assigned to the third supporting body 637. These temperature control devices are preferably used for the targeted generation of a temperature difference between a first point 656 on said at least one third supporting body 637 and a second point 657 on said at least one third supporting body 637, said second point being spaced apart from said first point 656 on said at least one third supporting body 637, at least in transport direction T. In this way, similarly to the first supporting body 616, this third supporting body 637 can also be influenced accordingly in a targeted manner with respect to its deflection and/or its position relative to the second supporting body 636 and/or relative to the first supporting body 616. Preferably at least one, in particular seventh temperature control device 648, and further preferably at least one, in particular eighth temperature control device 649, which more preferably are similar in embodiment to the first and/or the second temperature control device 641; 642, are assigned to the fourth supporting body 638. These temperature control devices are preferably used for the targeted generation of a temperature difference between a first point 658 on said at least one fourth supporting body 638 and a second point 659 on said at least one fourth supporting body 638, said second point being spaced apart from said first point 658 on said at least one fourth supporting body 638, at least in transport direction T. In this way, similarly to the first supporting body 616, this fourth supporting body 638 can also be influenced accordingly in a targeted manner with respect to its deflection and/or its position relative to the third supporting body 637 and/or relative to the second supporting body 636 and/or relative to the first supporting body 616.

The deflection of the first supporting body 616 and the deflection of the second supporting body 636 and the deflection of the third supporting body 637 and the deflection of the fourth supporting body 638 are influenced in a coordinated manner, for example. For this purpose in particular, printing unit 200 is preferably characterized in that printing unit 200 has, in addition to the at least one first position sensor 673 and the at least one second position sensor 674, at least one third position sensor 676 for determining the position, at least with respect to transport direction T, of a fourth reference point 664 located on the second supporting body 636 in relation to a fifth reference point 666, and in that the fifth reference point 666 is stationary in relation to the third supporting body 637 of printing unit 200, and in that printing unit 200 additionally has at least one fourth position sensor 677 for determining the position, at least with respect to transport direction T, of a sixth reference point 667 located on the third supporting body 637 relative to a seventh reference point 668, and in that the seventh reference point 668 is stationary in relation to the fourth supporting body 638 of printing unit 200, and in that printing unit 200 additionally has at least one fifth position sensor 678 for determining the position, at least with respect to transport direction T, of an eighth reference point 669, located on the fourth supporting body 638, relative to another reference point 672 embodied as the second fixed reference point 672, and in that the second fixed reference point 672 is stationary relative to frame 283 of printing unit 200.

A coordinated positioning of the first supporting body 616 and the second supporting body 636 and the third supporting body 637 and the fourth supporting body 638 is preferably carried out. For this purpose in particular, printing unit 200 is preferably characterized in that printing unit 200 has at least one position sensor 674 for determining the position, at least with respect to transport direction T, of a reference point 662, located on the first supporting body 616, in relation to another reference point 663, which is stationary relative to the second supporting body 636, and in that printing unit 200 has at least one position sensor 676 for determining the position, at least with respect to transport direction T, of a reference point 664, located on the second supporting body 636, in relation to another reference point 666, which is stationary relative to the third supporting body 637, and in that printing unit 200 has at least one position sensor 677 for determining the position, at least with respect to transport direction T, of a reference point 667, located on the third supporting body 637, in relation to another reference point 668, which is stationary relative to the fourth supporting body 638.

Printing unit 200 additionally or alternatively has, for example, at least one first strain sensor, in particular for determining at least the expansion of at least one reference section of at least the first supporting body 616. The at least one first strain sensor is located on the first supporting body 616, for example. The at least one first strain sensor is embodied, for example, as a first strain gauge. The at least one first strain sensor can preferably be used to determine the expansion of at least one reference section of at least the first supporting body 616. In this way, data relating in particular to a change in the expansion of the corresponding reference section can be obtained. For example, if the first supporting body 616 is heated on only a rear side as viewed in the transport direction, this heating will cause a deflection of the first supporting body 616, in particular because the heated side will expand more, in particular, than an opposite side with respect to the transport direction. The deflection of the first supporting body 616 can then be determined based on the expansion of the one side. In particular, a desired situation in terms of the deflection of the first supporting body 616 can be determined based on the desired expansion of the reference section. This determination is reached, for example, from a calculated and/or empirically determined correlation between an expansion of the reference section and a corresponding deflection of the first supporting body 616 and/or an effect on a printed image. The information regarding the expansion of the reference section therefore provides position information regarding the position of the at least one first reference point 661, located on the at least one first supporting body 616, relative to at least one other reference point 663; 671, or is at least preferably uniquely linked to such position information. At least one first strain sensor is located at the first point 651 on the at least one first supporting body 616, for example, and/or at a distance of preferably at most 50 cm, more preferably at most 20 cm, even more preferably at most 5 cm, and more preferably still at most 1 cm from the first point 651 on the at least one first supporting body 616.

More preferably, at least two strain sensors are located on the at least one first supporting body 616, in particular, for determining at least the expansion of each of at least two reference sections of the first supporting body 616, these at least two reference sections preferably being located on opposite sides of the first supporting body 616. The deflection of the first supporting body 616 can then be determined with even greater precision from the information regarding the expansions of the two reference sections, for example by subtraction, or by a more complex model. At least one first strain sensor is located, for example, at the first point 651 on the at least one first supporting body 616, and/or at a distance of preferably at most 50 cm, more preferably at most 10 cm, even more preferably at most 5 cm, and more preferably still at most 1 cm from the first point 651 on the at least one first supporting body 616, and at least one second strain sensor is located at the second point 652 on the at least one first supporting body 616 and/or at a distance of preferably at most 50 cm, more preferably at most 20 cm, even more preferably at most 5 cm, and more preferably still at most 1 cm from the second point 652 on the at least one first supporting body 616.

Printing unit 200 is preferably alternatively or additionally characterized in that the at least one image-generating device 212 is stationary relative to the supporting body 616; 636; 637; 638 that supports it, regardless of the temperature of the supporting body 616; 636; 637; 638 that supports it, and/or regardless of the temperature of any temperature control device 641; 642; 643; 644; 646; 647; 648; 649 located on the supporting body 616; 636; 637; 638 that supports it.

Printing unit 200 is preferably alternatively or additionally characterized in that a plurality of image-generating devices 212 are arranged on each supporting body 616; 636; 637; 638, the relative positioning of said devices being independent of the temperature of the supporting body 616; 636; 637; 638 that supports them and/or independent of the temperature of any temperature control device 641; 642; 643; 644; 646; 647; 648; 649 located on the supporting body 616; 636; 637; 638 that supports them. For example, at least two, more preferably at least five, and even more preferably at least ten first image-generating devices 212 are arranged on each supporting body 616; 636; 637; 638, more preferably offset relative to one another and/or spaced from one another in transverse direction A.

Printing unit 200 enables a preferred method for operating printing unit 200, which comprises at least the first supporting body 616 on which the at least one first image-generating device 212 is located, wherein the at least one transport direction T is defined by the transport path provided for the transport of printing substrate 02 through the printing unit 200, and wherein position information regarding the position of the at least one first reference point 661 located on the at least one first supporting body 616 in relation to at least one additional reference point 663; 671 is obtained from a measurement, and wherein the at least one additional reference point 663; 671 is stationary relative to frame 283 of printing unit 200 and/or is stationary relative to the second supporting body 636 of printing unit 200 that supports the at least one second image-generating device 212. In said method, at least one first temperature control means 641 is operated in a controlled and/or regulated manner, preferably based at least on this position information, to influence the temperature of at least the first point 651 on this at least one first supporting body 616 in a targeted manner. If the temperature control device 641; 642; 643; 644; 646; 647; 648; 649 is a wire heating element and/or a Peltier element, for example, controlled and/or regulated operation involves a controlled and/or regulated supply of current, and/or if said device is a fluid line, controlled and/or regulated operation involves a control and/or regulation of the temperature and/or the flow rate of a temperature control fluid, and/or if said device is a radiation source, controlled and/or regulated operation involves a control and/or regulation of radiation intensity.

Alternatively or additionally, during printing operation of the printing unit 200, the controlled and/or regulated operation of the at least one first temperature control device 641 is carried out based at least on this position information.

Alternatively or additionally, likewise based at least on this position information, the temperature at least at the first point 651 on this at least one supporting body 616 is preferably adjusted in a targeted manner to a temperature that is different from the temperature at least at a second point 652 on said at least one first supporting body 616.

Alternatively or additionally, likewise based at least on this position information, the temperature at least at the first point 651 on this at least one first supporting body 616 is preferably adjusted in a targeted manner to a temperature that is different from the temperature that has heretofore prevailed at said first point 651. Alternatively or additionally, likewise based at least on this position information, the temperature at the second point 652 on this at least one first supporting body 616 is preferably adjusted in a targeted manner to a temperature that is different from the temperature at the at least one first point 651 on said at least one first supporting body 616. Alternatively or additionally, likewise based at least on this position information, the temperature at least at the second point 651 on this at least one first supporting body 616 is preferably adjusted in a targeted manner to a temperature that is different from the temperature that has heretofore prevailed at said second point 652.

The position information regarding the position of the at least one first reference point 661, located on the at least one first supporting body 616, relative to at least one other reference point 663; 671 is obtained, for example, from the information regarding the expansion of the reference section, and/or alternatively or additionally from a direct measurement of this position, and/or from at least one register measurement of a printed image, and/or from at least one temperature measurement on the at least one supporting body 616, and/or from at least one measurement of an expansion of at least one reference section of at least the first supporting body 616. At least one position sensor 673; 674; 676; 677; 678, in particular at least one non-contact position sensor 673; 674; 676; 677; 678, is used for measuring this at least one position. Examples of such position sensors 673; 674; 676; 677; 678 include optical sensors, in particular laser sensors, capacitive sensors, ultrasonic sensors and preferably eddy current sensors. Eddy current sensors have the particular advantage of being relatively insensitive to contaminants. Alternatively or additionally, at least one strain sensor is used for acquiring position information, for example at least one strain sensor per supporting body 616, and preferably two strain sensors per supporting body 616. Strain gauges are examples of such strain sensors.

The temperature at least of the at least one first point 651 on the first supporting body 616 is preferably influenced and/or adjusted within the context of a control process, in which the position information regarding the position of at least a first reference point 661, located on the at least one first supporting body 616, in relation to the at least one additional reference point 663; 671 is used. For example, the control process is a position control with respect to the position of the first reference point 661 relative to the position of the first fixed reference point 671, which is stationary on frame 283. Preferably, the control process is a position control with respect to the position of reference point 663 on the second supporting body 636 relative to the position of reference point 662 on the first supporting body 616.

For example, a one-meter expansion of the first supporting body 616 in transverse direction A allows the position with respect to transport direction T of the center of the first supporting body 616 with respect to transverse direction A to be influenced by up to 1 μm (one micrometer) or more.

Preferably, at least one sensor embodied as a first printed image sensor is provided, more preferably at a point downstream of the first printing element 211 along the transport path of printing substrate web 02. The at least one first printed image sensor is embodied, for example, as a first line scan camera or as a first area scan camera. The at least one first printed image sensor is embodied, for example, as at least one CCD sensor and/or as at least one CMOS sensor. This at least one first printed image sensor and a corresponding evaluation unit, for example the higher-level machine controller, are preferably used for monitoring and controlling the actuation of all print heads 212 and/or double rows of print heads 212 of the first printing element 211, positioned and/or acting one behind the other in the circumferential direction of the at least one first central cylinder 201.

A layer of pixels formed by printing ink droplets emerging from a first print head 212 in each case is preferably compared with a layer of pixels formed by printing ink droplets emerging from a second print head 212 in each case, located downstream of said first print head 212 in transport direction T of printing substrate 02 and/or in longitudinal direction B and/or in the circumferential direction of the at least one first central cylinder 201. This is preferably carried out independently of whether these first and second print heads 212 positioned and/or acting one behind the other in the corresponding direction are each processing the same printing ink or different printing inks. For example, the harmonization of the layers of the printed images originating from different print heads 212 is monitored. If the same printing inks are used, a true-to-register merging of partial images is monitored, for example. If different printing inks are used, registration or color register is monitored, for example. The measured values from the at least one printed image sensor are preferably also used for controlling the quality of the printed image.

At least one result of an analysis of data from the at least one printed image sensor is used, for example, for controlling and/or for regulating at least one temperature control device 641; 642; 643; 644; 646; 647; 648; 649. In this way, a coordinated relative positioning of the supporting body 616; 636; 637; 638 and of the print heads 212 arranged thereon can be carried out, with the quality that is generated being used directly in the control and/or regulation of temperature control devices 641; 642; 643; 644; 646; 647; 648; 649.

Preferably, the method is alternatively or additionally characterized in that before a printing operation is started, the supporting body 616; 636; 637; 638 in question is heated by means of the appropriate at least one temperature control device 641; 642; 643; 644; 646; 647; 648; 649. This allows conditions similar or identical to those that occur during a longer printing operation to be created. As a result, high-quality printing can be achieved even with short print jobs.

Printing machine 01 preferably has at least one supply system for coating medium, in particular at least one printing ink supply system. Preferably, a plurality of print heads 212, for example a plurality of print heads 212 of a common nozzle bar 213, in particular a plurality of or more preferably all of the print heads 212 of each double row of print heads 212 have a common supply system for coating medium. The at least one supply system and in particular the common supply system for coating medium preferably has at least one normal reservoir 252, in particular at least one normal reservoir 252 for coating medium.

At least one fluid line, preferably embodied as an ink line, is connected to each at least one normal reservoir 252 per print head 212, for example. In particular, each of at least two print heads 212 is preferably connected and/or connectable, preferably directly, to the at least one normal reservoir 252 via at least one first fluid line. Each first fluid line can be a flexible line, for example, in particular at least one tube. The at least one normal reservoir 252 preferably is and/or can be connected via a feed line and a discharge line, either directly or via interposed components 295 such as at least one return flow reservoir 295, to at least one intermediate reservoir for the at least one coating medium.

Preferably, the at least one printing unit 200; 400 has a plurality of normal reservoirs 252, more preferably at least one normal reservoir 252 per printing ink to be printed, for example, four normal reservoirs 252. This case is preferable especially when print heads 212 that are associated with different printing inks are aligned at different angles from vertical and/or are situated at different heights, because in such cases, relevant hydrostatic pressures result in different liquid column levels. This case is preferable especially when print heads 212; 412 are mounted such that they can be moved relative to one another, for example to different positions such as printing positions and/or idle positions, for example by means of corresponding positioning devices 217; 218; 219; 221. More preferably, therefore, two normal reservoirs 252 are provided per double row of print heads 212; 412, i.e. in particular four normal reservoirs 252 per coating medium. Each printing unit 200; 400 preferably has one return flow reservoir 295 per nozzle bar 213 and/or per positioning device 217; 218; 219; 221, said reservoir being at least indirectly connected to four normal reservoirs 252.

The at least one normal reservoir 252 can preferably be moved together with the at least one print head 212; 412 and/or the at least one nozzle bar 213; 413 by means of a corresponding positioning device 217; 218; 219; 221, and/or the at least one return flow reservoir 295 can preferably be moved together with the at least one print head 212; 412 and/or the at least one normal reservoir 252 and/or the at least one nozzle bar 213; 413 by means of a corresponding positioning device 217; 218; 219; 221. This ensures, in particular, constant hydrostatic pressure conditions, for example within the at least one normal reservoir 252 and/or within the at least one print head 212; 412.

Once printing substrate web 02 has passed through the at least one first printing unit 200, printing material web 02 is transported further along its transport path and is preferably fed to the at least one first dryer 301 of the at least one dryer unit 300. The first side of printing substrate web 02, printed by the at least one first printing unit 200, preferably is not in contact with any component of web-fed printing machine 01 between the last point of contact between printing substrate web 02 and the at least one first central cylinder 201 of the at least one first printing unit 200 and the operating zone of the at least one first dryer 301. The second side of printing substrate web 02, in particular not printed by the first printing unit 200, which side touches the at least one first central cylinder 201 of the at least one first printing unit 200, is preferably in contact with at least one deflecting roller 214 of the at least one first printing unit 200 and/or with at least one deflecting roller 312 of the at least one first dryer 301 between the last point of contact of printing substrate web 02 with the first central cylinder 201 of the at least one first printing unit 200 and the operating zone of the at least one first dryer 301. The at least one first dryer 301 is preferably embodied as a radiation dryer 301, in particular infrared radiation dryer 301 and/or UV radiation dryer 301, and/or as an air flow dryer 301, in particular hot air dryer 301. The at least one first dryer 301 preferably has at least one radiation source 302, preferably embodied as an infrared radiation source 302. At least one first cooling device 303 is preferably located downstream of the operating zone of the at least one radiation source 302 of the at least one first dryer 301, in transport direction T of printing substrate web 02. The at least one first cooling device 303 preferably has at least one first cooling roller 304 and preferably has a first cooling impression roller 306 that can be and/or is thrown onto the at least one first cooling roller 304, and preferably has at least one turning roller 307; 308 that can be and/or is thrown onto the at least one first cooling roller 304.

Downstream of the at least one first cooling device 303 along the transport path of printing substrate web 02, at least one second printing unit 400 is preferably located. Preferably, at least one second web edge aligner is preferably located immediately upstream of the at least one second printing unit 400, and preferably downstream of the at least one first dryer 301, in particular downstream of the at least one first printing unit 200, along the transport path of printing substrate web 02. The at least one second printing unit 400 is preferably similar in configuration to the first printing unit 200. In particular, the second printing unit 400 has a printing substrate guide element 401 embodied as a second central printing cylinder 401, or central cylinder 401 for short. The transport path of printing substrate web 02 through the at least one second printing unit 400 extends similarly to the transport path through the at least one first printing unit 200. In particular, printing substrate web 02 preferably wraps around part of a second deflecting roller 403 and is deflected by said roller in such a way that the transport path of printing substrate web 02 in the second intermediate space 404 runs both tangentially to the second deflecting roller 403 and tangentially to the second central cylinder 401. At least one cylinder 406 embodied as a second impression roller 406 is preferably provided in the second printing unit 400. The second impression roller 406 is preferably similar in configuration and disposition to the first impression roller 206, in particular with respect to its mobility and with respect to a second impression nip 409. The second central cylinder 401 is preferably similar in disposition and configuration to the first central cylinder 201, in particular with respect to a second drive motor 408 of the second central cylinder 401 and with respect to a preferably correspondingly disposed second angular sensor that measures and/or is capable of measuring the angular position of the second drive motor 408 and/or of the second central cylinder 401 itself, and that transmits and/or is capable of transmitting said measurement to the higher-level machine controller.

At least one second printing element 411, embodied as an inkjet printing element 411, is preferably provided within the second printing unit 400. The at least one second printing element 411 of the at least one second printing unit 400 is preferably configured similarly to the at least one first printing element 211 of the at least one first printing unit 200, in particular with respect to at least one nozzle bar 413 of at least one image-generating device 412 embodied as a print head 412, in particular an inkjet print head 412, and the arrangement thereof in double rows, the arrangement, alignment, and actuation of the nozzles, and the mobility and adjustability of the at least one nozzle bar 413 and of the at least one print head 412 by means of at least one adjustment mechanism having a corresponding electric motor. At least one second dryer 331 of the at least one dryer unit 300 is located downstream of the at least one second printing unit 400 with respect to the transport path of printing substrate web 02. The at least one second dryer 331 is preferably similar in configuration to the at least one first dryer 301. In particular, the at least one second dryer 331 preferably has at least one second cooling roller 334. The at least one second dryer 331 is preferably configured substantially symmetrically, more preferably fully symmetrically, to the at least one first dryer 301 in terms of the described components. The at least one first dryer 301 and the at least one second dryer 331 are preferably components of the at least one dryer unit 300. In terms of spatial arrangement, dryer unit 300 and thus preferably the at least one first dryer 301 and the at least one second dryer 331 are preferably located between the at least one first printing unit 200 and the at least one second printing unit 400.

Downstream of the at least one second dryer 331 along the transport path of printing substrate web 02, at least one draw roller 501 is located. The at least one draw roller 501 preferably has a dedicated drive motor 504, embodied as draw roller drive 504. Downstream of drawing nip 503 and/or downstream of a rewetting device along the transport path of printing substrate web 02, at least one post-processing device 500 is provided, which is preferably embodied as folding device 500 and/or preferably has a sheet cutter 500 and/or a flat delivery unit 500, or is preferably embodied as a winding apparatus 500.

At least one infeed means that can be moved along at least one infeed path for feeding in a printing substrate web 02, and/or at least one infeed means that can be moved along at least one designated transport path of printing substrate web 02 for feeding in a printing substrate web 02 preferably is and/or can be at least intermittently positioned at least within one printing unit 200; 400 of printing machine 01. Preferably, at least one infeed guide element is provided, by means of which at least one infeed path of the at least one infeed means can be and/or is defined. The at least one infeed guide element is embodied as at least one deflecting roller, for example. Alternatively, the at least one infeed guide element is embodied as at least one chain track. A chain track in particular can also have switches for creating different infeed paths.

In at least one variant of the printing machine, printing machine 01 is embodied as a web-fed rotary inkjet printing machine 01, and at least one transfer element is positioned to form a transfer nip together with the at least one first central printing cylinder 201. In that case, the at least one print head 212 is preferably aligned toward the at least one transfer element.

While preferred embodiments of a printing assembly and a method for operating a printing assembly, in accordance with the present invention, have been set forth fully and completely hereinabove, it will be apparent to one of skill in the art that various changes could be made without the departing from the true spirit and cope of the present invention which is accordingly to be limited only by the appended claims.

The invention claimed is:

1. A printing unit (200), wherein at least one transport direction (T) is defined by a transport path for the transport of printing substrate (02) through the printing unit (200), and wherein the printing unit (200) has at least one first supporting body (616), on which at least one first image-generating device (212) is located and which extends both in the transport direction (T) and in a transverse direction (A) oriented horizontally and orthogonally to the transport direction (T), characterized in that the printing unit (200) has at least one first temperature control device (641; 642) for the targeted generation of a temperature difference between a first point (651) on said at least one first supporting body (616) and a second point (652) on said at least one first supporting body (616), said second point being spaced apart from said first point (651), at least in the transport direction (T).

2. The printing unit according to claim 1, characterized in that a plurality of first image-generating devices (212) is provided on the first supporting body (616), offset and/or spaced relative to one another with respect to the transverse direction (A).

3. The printing unit according to claim 1, characterized in that the printing unit (200) has at least one second supporting body (636), on which at least one second image-generating device (212) is located, and in that the printing unit (200) has at least one position sensor (673; 674) for determining the position, at least with respect to the transport direction (T), of a first reference point (661), located on the first supporting body (616), in relation to another reference point (663; 671), and in that the other reference point (663; 671) is stationary relative to the second supporting body (636) of the printing unit (200), said supporting body supporting the at least one second image-generating device (212).

4. The printing unit according to claim 1, characterized in that the printing unit (200) has at least one second supporting body (636), on which at least one second image-generating device (212) is located, and in that the printing unit (200) has at least one additional temperature control device (643) for the targeted generation of a temperature difference between a first point (653) on said at least one second supporting body (636) and a second point (654) on said at least one second supporting body (636), said second point being spaced apart from said first point (653), at least in the transport direction (T).

5. The printing unit according to claim 1, characterized in that the at least one first image-generating device (212) is embodied as at least one first inkjet print head (212).

6. The printing unit according to claim 3, characterized in that the at least one second image-generating device (212) is embodied as at least one second inkjet print head (212), and/or in that the at least one first image-generating device (212) is associated with a printing ink of a first color, and the at least one second image-generating device (212) is associated with an ink of a second color, different from the first color.

7. The printing unit according to claim 3, characterized in that at least one controlling and/or regulating device (679) is provided, and in that this at least one controlling and/or regulating device (679) is connected to the at least one first temperature control device (641) and/or to at least one first position sensor and/or to at least one first strain sensor.

8. The printing unit according to claim 1, characterized in that two ends of each supporting body (616; 636; 637; 638) with respect to the transverse direction (A) are stationary relative to a frame (283) of the printing unit (200).

9. The printing unit according to claim 4, characterized in that the printing unit (200) has at least one second supporting body (636), on which at least one second image-generating device (212) is located, and in that the printing unit (200) has at least one first position sensor (673) for determining the position, at least with respect to the transport direction (T), of a first reference point (661), located on the first supporting body (616), relative to a first fixed reference point (671), and in that the first fixed reference point (671) is stationary relative to a frame (283) of the printing unit (200), and in that the printing unit (200) has at least one second position sensor (674) for determining the position, at least with respect to the transport direction (T), of a second reference point (662), located on the first supporting body (616), relative to a third reference point (663), and in that the third reference point (663) is stationary relative to the second supporting body (636) of the printing unit (200).

10. The printing unit according to claim 4, characterized in that the printing unit (200) has at least one first position sensor (673) for determining the position, at least with respect to the transport direction (T), of a first reference point (661), located on the first supporting body (616), relative to another reference point (663; 671), the other reference point (663; 671) being stationary relative to a frame (283) of the printing unit (200).

11. A method for operating a printing unit (200) that has at least one first supporting body (616), on which at least one first image-generating device (212) is located, wherein at least one transport direction (T) is defined by a transport path provided for the transport of printing substrate (02) through the printing unit (200), and wherein position information regarding the position of at least one first reference point (661), located on the at least one first supporting body (616), in relation to at least one other reference point (663; 671) is obtained from a measurement, and wherein the at least one other reference point (663; 671) is stationary relative to a second supporting body (636) of the printing unit (200), said second supporting body supporting at least one second image-generating device (212), and wherein based at least on this position information, at least one first temperature control means (641) is operated in a controlled and/or regulated manner for the targeted influencing of the temperature at least at a first point (651) on said at least one first supporting body (616).

12. The method according to claim 11, characterized in that during a printing operation of the printing unit (200), the at least one first temperature control means (641) is operated in a controlled and/or regulated manner based at least on this position information.

13. The method according to claim 11, characterized in that, based at least on this position information, the temperature at the at least one first point (651) on this at least one supporting body (616) is adjusted in a targeted manner to a temperature that is different from the temperature at least at a second point (652) on said at least one first supporting body (616).

14. The method according to claim 11, characterized in that the control involves a position control with respect to the position of the reference point (663) of the second supporting body (636) relative to the position of the reference point (662) of the first supporting body (616).

15. A method for operating a printing unit (200) that has at least one first supporting body (616) on which at least one first image-generating device (212) is located, wherein at least one transport direction (T) is defined by a transport path provided for the transport of printing substrate (02) through the printing unit (200), and wherein position information regarding the position of at least one first reference point (661), located on the at least one first supporting body (616), in relation to at least one other reference point (663; 671) is obtained from a measurement, and wherein the at least one other reference point (663; 671) is stationary relative to a frame (283) of the printing unit (200), and wherein based at least on this position information, at least one first temperature control means (641) is operated in a controlled and/or regulated manner for the targeted influencing of the temperature at least at a first point (651) on said at least one first supporting body (616), and in that during a printing operation of the printing unit (200), the at least one first temperature control means (641) is operated in a controlled and/or regulated manner based at least on this position information.

* * * * *